US011503399B2

(12) United States Patent
Zhang et al.

(10) Patent No.: US 11,503,399 B2
(45) Date of Patent: Nov. 15, 2022

(54) REPLACEABLE MESH IN PORTABLE ELECTRONIC DEVICES

(71) Applicant: Apple Inc., Cupertino, CA (US)

(72) Inventors: Mei Zhang, Cupertino, CA (US); Benjamin A. Cousins, Campbell, CA (US); Mohammad Soroush Ghahri Sarabi, Menlo Park, CA (US); Phillip Qian, Tokyo (JP); Sean T. McIntosh, Cupertino, CA (US); Michael B. Minerbi, San Francisco, CA (US); Lee M. Panecki, Los Gatos, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 17/242,182

(22) Filed: Apr. 27, 2021

(65) Prior Publication Data

US 2022/0103930 A1 Mar. 31, 2022

Related U.S. Application Data

(60) Provisional application No. 63/083,467, filed on Sep. 25, 2020.

(51) Int. Cl.
*H04R 1/10* (2006.01)

(52) U.S. Cl.
CPC ..... *H04R 1/1075* (2013.01); *H04R 1/1016* (2013.01); *H04R 2201/10* (2013.01); *H04R 2420/07* (2013.01)

(58) Field of Classification Search
CPC ..... H04R 1/023; H04R 1/1016; H04R 25/65; H04R 25/654; H04R 2499/11
See application file for complete search history.

(56) References Cited

U.S. PATENT DOCUMENTS 2,826,649 A * 3/1958 Desbrow ..... H04M 1/03 181/242
4,546,850 A * 10/1985 Litner ..... H04R 1/025 381/86
5,322,979 A * 6/1994 Cassity ..... H04R 1/023 181/150
5,400,413 A * 3/1995 Kindel ..... H04R 1/023 381/189
6,134,333 A * 10/2000 Flagler ..... H04R 25/652 381/328
6,354,397 B1 * 3/2002 Combest ..... H04R 1/023 181/150
6,364,053 B1 * 4/2002 Huerth ..... H04R 1/023 181/199
8,265,323 B2 * 9/2012 Stiehl ..... H04R 1/1016 381/371
8,515,115 B2 * 8/2013 Kelly ..... H04R 1/1016 381/384
9,161,111 B2 * 10/2015 Yuan ..... H04R 1/026

(Continued)

*Primary Examiner* — Ryan Robinson

(74) *Attorney, Agent, or Firm* — Kilpatrick Townsend & Stockton LLP

(57) ABSTRACT

A wireless earphone comprising a housing that defines an interior cavity having an inner surface and an outer surface; an opening extending through the housing from the inner surface to the outer surface; and a mesh assembly disposed over the opening and comprising a permanent assembly coupled to the housing and a replaceable assembly removably coupled to the permanent assembly and comprising a mesh.

8 Claims, 18 Drawing Sheets

(56) References Cited

U.S. PATENT DOCUMENTS

| | | | | |
|---|---|---|---|---|
| 9,237,389 | B2 * | 1/2016 | Yu | H04R 1/02 |
| 9,369,816 | B2 * | 6/2016 | Yoong | H04R 25/654 |
| 9,736,563 | B1 * | 8/2017 | Glass | H04R 5/033 |
| 9,743,168 | B2 * | 8/2017 | Kurtz | H04R 1/345 |
| 9,930,433 | B2 * | 3/2018 | Subat | B60R 11/0217 |
| 10,003,879 | B2 * | 6/2018 | Yang | H04R 1/1016 |
| 10,097,913 | B2 | 10/2018 | Zorkendorfer et al. | |
| 10,448,141 | B2 * | 10/2019 | Na | H04R 1/2803 |
| 10,490,175 | B2 * | 11/2019 | Oshiro | H04R 1/2823 |
| 10,516,924 | B2 * | 12/2019 | Chappell | F24F 13/084 |
| 10,591,326 | B2 * | 3/2020 | Lim | B81B 7/0061 |
| 10,715,916 | B2 * | 7/2020 | Matsumoto | B60N 2/64 |
| 10,986,433 | B2 | 4/2021 | McIntosh et al. | |
| 2009/0245565 | A1 * | 10/2009 | Mittleman | H04R 1/28<br>381/189 |
| 2018/0084339 | A1 * | 3/2018 | Asuncion | H04N 5/2252 |
| 2018/0213316 | A1 * | 7/2018 | Oishi | H04R 1/1016 |
| 2019/0033505 | A1 * | 1/2019 | Cross | A61B 5/0082 |
| 2019/0116411 | A1 * | 4/2019 | Duckwall | H04R 1/1008 |
| 2021/0240436 | A1 * | 8/2021 | Liddell | G06F 3/0362 |
| 2021/0243514 | A1 * | 8/2021 | Hatfield | H04R 1/1016 |
| 2022/0103918 | A1 * | 3/2022 | Proni | H04R 1/023 |

* cited by examiner

REPLACEABLE MESH IN PORTABLE ELECTRONIC DEVICES

CROSS-REFERENCES TO RELATED APPLICATION

This application claims the benefit of U.S. Provisional Application No. 63/083,467, filed Sep. 25, 2020 entitled "Replaceable Mesh In Portable Electronic Devices," the disclosure which is incorporated by reference herein in its entirety.

FIELD

This disclosure generally applies to electronic devices that include a mesh disposed over an audio opening in a housing of the device.

BACKGROUND

Portable listening devices, such as wireless earphones, typically include a speaker for reproducing audio content and one or more microphones for capturing audio signals by converting sound waves into electrical energy that can be transmitted, recorded or otherwise processed. For example, at least one speaker can be disposed within a housing of the portable listening device and an audio exit in the housing can allow sound waves generated by the speaker to be transmitted from the speaker to a user's ear so that the user can listen to music or other audio recordings stored on or received by a host portable electronic device paired with the portable listening device. As another example, a microphone can be disposed within a housing of the portable listening device and a microphone opening in the housing can allow sound waves generated in the environment the portable listening device is positioned within to reach the microphone causing a diaphragm of the microphone, a membrane, to vibrate which in turn can produce a varying electric current that represents the sound waves.

In general, portable listening devices typically include a mesh covering disposed over the audio openings, such as those described above, to protect the speaker and/or the microphone. The mesh can prevent dust, debris, and other foreign objects from reaching sensitive components of the speaker and microphone, such as the speaker diaphragm or microphone membrane.

Mesh coverings, however, can get clogged by the foreign objects they are designed to trap which can lead to decreased performance of a speaker or microphone since audio waves cannot penetrate the foreign objects clogging the mesh.

BRIEF SUMMARY

The present disclosure describes various embodiments of a portable listening device, such as an earphone, that includes a removable mesh disposed over an audio opening in a housing of the portable electronic device. The audio opening can be an opening through which a speaker can transmit audio waves, an opening through which a microphone can receive audio waves, an opening that allows audio pressure from within the housing to vent, or any other opening through the housing for which a mesh can beneficially provide protection. The mesh can be removably coupled to the portable listening device so that, if the mesh becomes fully or partially clogged or otherwise damaged, the mesh can quickly and easily be removed from the portable listening device and replaced with a new mesh.

A wireless earphone according to some embodiments includes a housing that defines an interior cavity having an inner surface and an outer surface; an opening extending through the housing from the inner surface to the outer surface; and a mesh assembly disposed over the opening. The mesh assembly can include a permanent assembly coupled to the housing and a replaceable assembly removably coupled to the permanent assembly and including a mesh. In some instances the mesh can be a multilayer mesh that includes an acoustic mesh and a cosmetic mesh.

In various implementations, the wireless earphone can include one or more of the following features. The mesh can include an acoustic mesh and an outer cosmetic mesh. The replaceable assembly can be removably coupled to the permanent assembly by a wire form attachment. The replaceable assembly can be removably coupled to the permanent assembly by an adhesive layer. The adhesive layer can include a debondable pressure sensitive adhesive section. The replaceable assembly can be removably coupled to the permanent assembly by one or more magnets.

In some embodiments, a portable listening device is provided. The portable listening device can include: a housing that defines an interior cavity having an inner surface and an outer surface; an opening extending through the housing from the inner surface to the outer surface; and a replaceable mesh disposed over the opening and removably coupled to the housing.

In various implementations, the portable listening device can include one or more of the following features. The replaceable mesh can be mechanically secured to the housing by a wire form attachment. The replaceable mesh can be secured to the housing by an adhesive layer. The adhesive layer can include a debondable pressure senstitive adhesive section. The replaceable mesh can be secured to the housing by one or more magnets. The replaceable mesh can be part of a mesh assembly that comprises a permanent assembly and a replaceable assembly where the permanent assembly is affixed to the housing and the replaceable assembly includes the replaceable mesh.

A wireless earbud according to some embodiments includes: a housing that defines an interior cavity having an inner surface and an outer surface; an acoustic opening extending through the housing from the inner surface to the outer surface; an audio driver disposed within the interior cavity and aligned to emit sound through the acoustic opening; and a mesh assembly disposed over the acoustic opening. The mesh assembly can include a permanent assembly affixed to the housing and a replaceable assembly, that includes a mesh, removably coupled to the permanent assembly.

In various implementations, the wireless earbud can include one or more of the following features. The mesh can include an acoustic mesh and an outer cosmetic mesh. The mesh can annular frame having a central opening aligned with the acoustic opening. The acoustic mesh can be disposed between the annular frame and the cosmetic mesh. The permanent assembly can include first and second springs. Each spring can include a finger at its distal end. The replaceable assembly can include first and second openings formed through a sidewall of the annular frame. A finger of each spring can be aligned with and protrude through a respective one of the first or second openings when the replaceable assembly is coupled to the permanent assembly. The replaceable assembly can include first and second springs. Each spring can include a tab at its distal end. The permanent assembly can include first and second openings formed through an annular frame where a tab of each spring is aligned with and protrudes through a respective one of the first or second openings when the replaceable assembly is coupled to the permanent assembly. The first and second springs can be wire form springs positioned in a mirrored relationship with each other. Each wire form spring can include first and second end segments at opposing ends of the spring and a central u-shaped section between the first and second end segments.

To better understand the nature and advantages of the present invention, reference should be made to the following description and the accompanying figures. It is to be understood, however, that each of the figures is provided for the purpose of illustration only and is not intended as a definition of the limits of the scope of the present invention. Also, as a general rule, and unless it is evident to the contrary from the description, where elements in different figures use identical reference numbers, the elements are generally either identical or at least similar in function or purpose.

BRIEF DESCRIPTION OF THE DRAWINGS

The disclosure will be readily understood by the following detailed description in conjunction with the accompanying drawings in which.

DETAILED DESCRIPTION

Figure 1A:
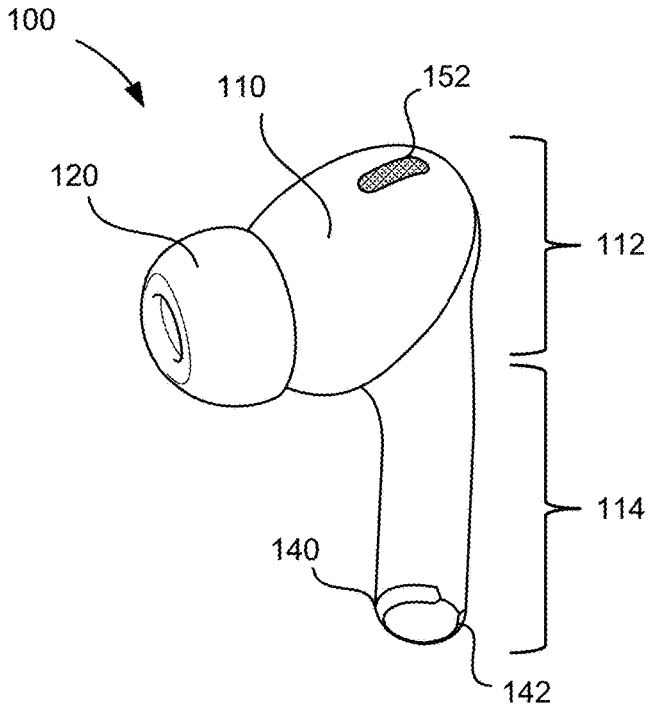
FIG. 1A illustrates a front perspective view of a portable listening device according to an embodiment of the disclosure.

The present invention will now be described in detail with reference to certain embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known details have not been described in detail in order not to unnecessarily obscure the present invention.

The present disclosure describes various embodiments of a portable listening device, such as an earphone. In order to provide robust protection for certain components of the portable listening device, a mesh covering can be used to cover some or all of the user facing audio ports to prevent foreign objects from reaching, contacting or damaging the components disposed behind the covered audio port. Mesh coverings, however, can become clogged with debris encountered during normal use. For example, a mesh covering on a portable listening device that is repeatedly placed in and out of a user's ear can become covered with ear wax and/or skin oils. As another example, when a mesh covering is exposed to certain liquid substances, such as milk, a residue can be left behind which can clog a portion of the mesh covering that was exposed to the liquid. Once a mesh covering becomes partially or fully clogged, the clogged covering can adversely impact the acoustic performance of the portable listening device.

As used herein, the term "portable listening device" includes any portable device configured to be worn by a user and placed such that a speaker of the portable listening device is adjacent to or in a user's ear. A "portable wireless listening device" is a portable listening device that is able to receive and/or send streams of audio data from or to a second device without a wire connecting the portable wireless listening device to the second device using, for example, a wireless communication protocol.

Headphones are one type of portable listening device, headsets (a combination of a headphone and an attached microphone) are another and hearing aids (in-ear devices that are designed to augment sounds from the surrounding environment to improve a user's hearing) are still an additional type of portable listening device. The term "headphones" represents a pair of small, portable listening devices that are designed to be worn on or around a user's head. Headphones convert an electrical signal to a corresponding sound that can be heard by the user. Headphones include both traditional headphones that are worn on or around a user's head and that include left and right ear cups connected to each other by a headband, and earphones (very small headphones that are designed to be fitted directly on or in a user's ear). Traditional headphones include both over-ear headphones (sometimes referred to as either circumaural or full-size headphones) that have ear pads that fully encompass a user's ears, and on-ear headphones (sometimes referred to as supra-aural headphones) that have ear pads that press against a user's ear instead of surrounding the ear.

The term "earphones" includes both small headphones, sometimes referred to as "earbuds", that fit within a user's outer ear facing the ear canal without being inserted into the ear canal, and in-ear headphones, sometimes referred to as canal phones, that are inserted in the ear canal itself. Thus, earphones can be another type of portable listening device that are configured to be positioned substantially within a user's ear. As used herein, the term "ear tip", which can also be referred to as an earmold, includes pre-formed, post-formed, or custom-molded sound-directing structures that at least partially fit within an ear canal. Ear tips can be formed to have a comfortable fit capable of being worn for long periods of time and can have different sizes and shapes to achieve a better seal with a user's ear canal and/or ear cavity.

According to embodiments described herein, a portable wireless listening device, such as an earphone, can include a removable mesh disposed over an audio opening in a housing of the portable electronic device through which a speaker can transmit audio waves or through which a microphone can receive audio waves. The mesh can be removably coupled to the portable listening device so that, if the mesh becomes clogged with ear wax, skin oil, liquid or other debris or otherwise damaged, the mesh can quickly and easily be removed from the portable listening device and replaced with a new mesh.

In order to simplify the description of various embodiments discussed herein, the discussion below repeatedly refers to an "earphone" or to "pair of earphones" or a "pair of wireless earphones" rather than referring to a more generic portable listening device. It is to be understood, however, that reference to an earphone is simply because of each of the specific examples described herein are with respect to an earphone. Embodiments of the invention can be useful in other types of portable listening devices including hearing aids, wired headsets, wireless or wired headphones and the like. Additionally, the techniques and features described herein can also be incorporated into any small portable electronic device that includes one or more mesh elements that protect an audio or other component within the device. For example, a replaceable mesh as described herein can be incorporated into a portable electronic device such as a smart phone, a tablet computer, a smart watch or a laptop computer, among other types of portable electronic devices, in various embodiments.

Example Portable Listening Device

Figure 1B:
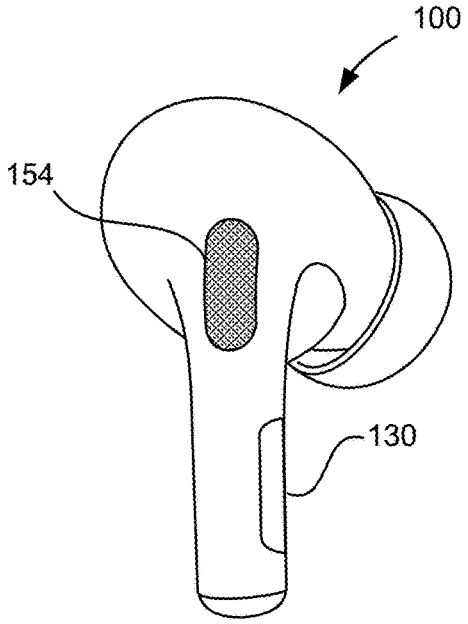
FIG. 1B illustrates a rear perspective view of the portable listening device shown in FIG. 1A.
Figure 1C:
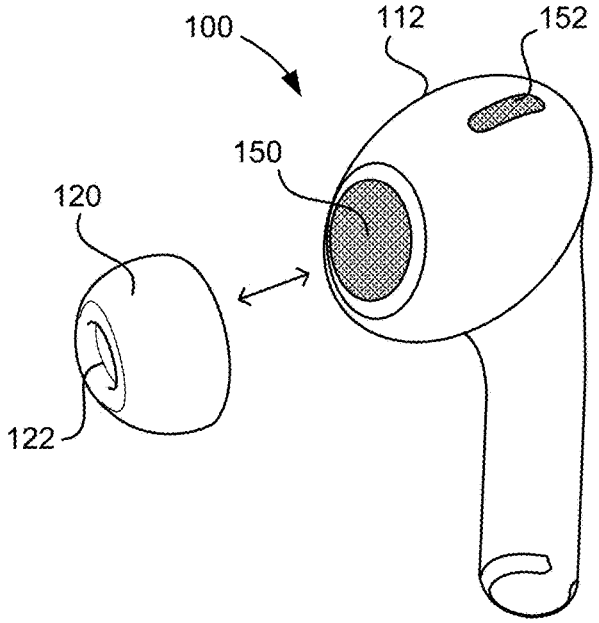
FIG. 1C illustrates a front perspective view of the portable listening device shown in FIG. 1A with its ear tip removed.

In order to better appreciate and understand the present invention, reference is first made to FIGS. 1A-1C, which depict an example earphone 100. Specifically, FIG. 1A illustrates a front perspective view of a portable listening device according to an embodiment of the disclosure; FIG. 1B illustrates a rear perspective view of the portable listening device shown in FIG. 1A; and FIG. 1C illustrates a front perspective view of the portable listening device shown in FIG. 1A with its ear tip removed. Those skilled in the art will readily appreciate that the description of earphone 100 in FIGS. 1A-1C is provided for illustrative purposes only and that, as discussed above, while earphone 100 is an in-ear headphone that represents a specific example of a portable listening device according to some embodiments, embodiments of the invention are not limited to in-ear headphones or to the specific features of earphone 100 as discussed below.

Earphone 100 can include a housing 110 and an ear tip 120 that can direct sound from an internal audio driver (e.g., a speaker) out of housing 110 and into a user's ear canal. Ear tip 120 can be made primarily from a deformable material and can be sized and shaped to fit within a user's ear canal In the embodiment depicted in FIGS. 1A-1C, ear tip can be removably attached to speaker housing 110 and is shown in FIG. 1A in an attached state and in FIG. 1C in a detached stated.

Housing 110 can include a speaker housing 112 and a stem 114 extending from the speaker housing 112. Stem 114 can be substantially cylindrical in construction, but it can include a planar region 130 that does not follow the curvature of the cylindrical construction. Planar region 130 can indicate an area where the wireless listening device is capable of receiving user input. For instance, a user input can be inputted by squeezing stem 114 at planar region 130. Stem 114 can also include electrical contacts 140 and 142 for making contact with corresponding electrical contacts in charging case (see e.g., FIG. 10) that can store and charge a pair of earphones 100.

In some embodiments housing 110 can be formed of a seemingly monolithic outer structure without any obvious seams or rough edges. Housing 110 can enclose an interior cavity (not shown) in which the various components of earphone 100 are positioned. For example, enclosed within housing 110 can be a processor or other type of controller, one or more computer-readable memories, wireless communication circuitry, an antenna, a rechargeable battery, power receiving circuitry and various sensors, such as an accelerometer, a photodetector, and the like, none of which are shown in FIG. 1. Housing 110 can also house an active driver (i.e., a speaker) and one or more microphones. The speaker and one or more microphones can each be positioned within housing 110 at a location adjacent to an audio opening that extends through housing 110 to allow the speaker and one or more microphones to transmit and receive audio waves through the housing.

Some or all of such audio openings can be covered by a mesh. For example, as shown in FIG. 1C, a mesh 150 can be disposed over an audio exit formed in speaker housing 112. A speaker can be positioned within the speaker housing and aligned to emit sound through the audio opening, through mesh 150 and through a central channel 122 that extends through ear tip 120 into a user's ear canal. As another example, a rear vent can be formed through speaker housing 112 and covered with a mesh 152. The rear vent can be acoustically coupled to a back volume of the speaker housing to provide improved acoustic performance of the earphone. As still another example, a microphone port can formed through housing 110 at a location where speaker housing 112 and stem 114 are joined and covered by a mesh 154. A microphone can be disposed within housing 110 at a location adjacent to the microphone port such that the microphone can receive sound waves through mesh 154 and through the microphone port.

According to embodiments disclosed herein, some or all of meshes 150, 152 and 154 can be attached to earphone 100 in a manner that allows the meshes to be replaced using relatively quick and easy techniques that do not damage the earphone or any of the permanent earphone components. For example, in some embodiments one or more of meshes 150, 152 and 154 can be mechanically attached to earphone 100 using an interference or snapping fit that allows the meshes to be removed with an appropriate tool or other device without damaging the earphones. In other embodiments the meshes can be magnetically secured to the earphones and in still other embodiments the meshes can be removably attached to the earphones with an adhesive, such as a pressure sensitive adhesive (PSA) that can be debonded when exposed to an external energy source, such as a sufficiently high voltage. These and other embodiments are discussed below with respect to FIGS. 2-8.

Mechanically Attached Meshes

Figure 2A:
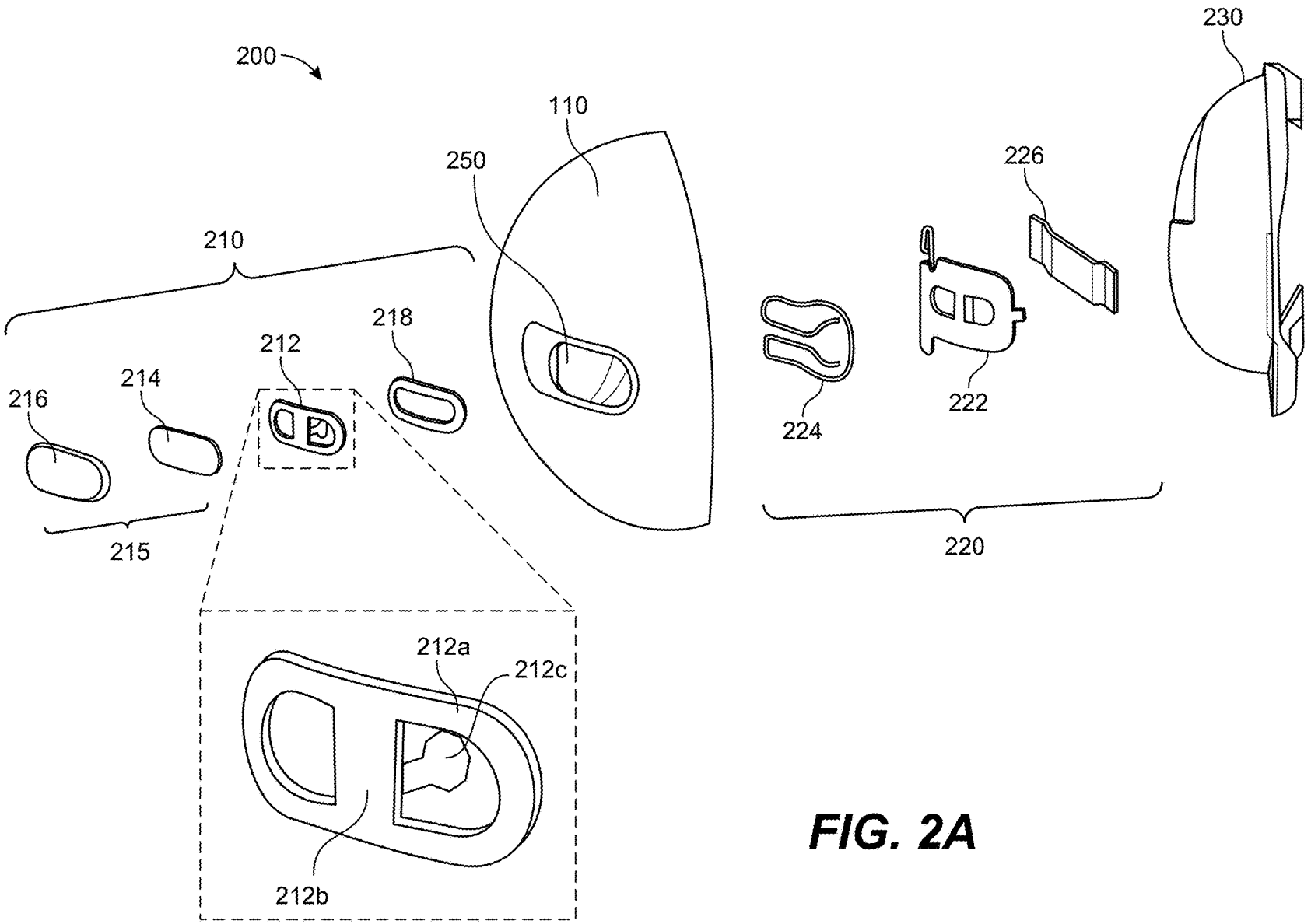
FIG. 2A is an exploded view of a mesh assembly that includes a replaceable mesh that can be mechanically secured to an earphone in accordance with some embodiments.

FIG. 2A is an exploded view of a mesh assembly 200 in accordance with some embodiments. Mesh assembly 200 can include a replaceable assembly 210 and a permanent assembly 220. The permanent assembly 220 can be positioned within an interior cavity of the earphone and can be affixed to a housing 110 and/or other portions of an earphone in a generally permanent manner. For example, permanent assembly 220 can be welded, glued or otherwise directly or indirectly attached to housing 110 in a manner such that the assembly is not intended to be replaced. Replaceable assembly 210, on the other hand, can be mechanically secured to permanent assembly 220 in a removable manner so that if the mesh gets clogged or otherwise damaged, the replaceable assembly 210 can be detached from the permanent assembly 220 and replaced with a new replaceable assembly.

The replaceable assembly 210 can include a stiffener 212, a mesh 215 and a seal 218. Stiffener 212 can provide structural integrity to the replaceable assembly 210 and in various embodiments can be made out of a metal (e.g., stainless steel), hard plastic or other suitable rigid material. In the embodiment depicted in FIG. 2A, stiffener 212 includes a rib 212*b* positioned between opposing ends of an outer, annular stiffener wall 212*a*. Outer wall 212*a* and rib 212*b* can include contours that conform to the topography of the external surface of housing 110. Rib 212*b* can bisect a central opening defined by outer annular wall 212*a* to provide additional structural rigidity across the length of replaceable assembly 210. Stiffener 212 can also include two tabs 212*c* attached to rib 212*b* and positioned in an opposing relationship and extending away from the rib 212*b* as described in more detail below with respect to FIG. 2D.

When mesh assembly 200 is fully assembled and coupled to housing 110, mesh 215 can be positioned over an acoustic opening 250 to prevent debris and other unwanted particles from falling into the housing through the acoustic opening. Acoustic opening 250 can be any acoustic opening formed through housing 110, such as one of openings 150, 152 or 154 described above. Mesh 215 can be an interlaced structure formed of a network of wire that allows sound to propagate through the mesh but prevents debris from passing through. In the embodiment depicted in FIGS. 2A-2D, mesh 215 is a multilayer mesh that includes an acoustic mesh 214 and a cosmetic mesh 216.

Acoustic mesh 214 can be constructed as a single layer with contours that conform to a topography of an external surface of a housing. In some instances, acoustic mesh 214 can be a porous layer that is tuned to a specific acoustic impedance to enable proper operation of an underlying microphone. In some embodiments, acoustic mesh 214 is formed of a pliable, porous material, such as a porous polyester. Acoustic mesh 214 can be covered with a hydrophobic coating that enables acoustic mesh 214 to resist ingress of water into the housing of the wireless listening device. Acoustic mesh 214 can be adhered to cosmetic mesh 216 via any suitable adhesive, such as pressure sensitive adhesive (PSA).

Cosmetic mesh 216 can be an interlaced structure formed of a network of stiff wire for providing a visible mesh texture to mesh assembly 200 when the wireless listening device is viewed from the outside. An outer surface of cosmetic mesh 216 can be positioned substantially flush with an external surface of housing 110 of earphone 100. Thus, an outer surface of cosmetic mesh 216 can form an external surface of the mesh assembly 200 and a portion of an external surface of earphone 100. When positioned over an audio opening, such as microphone aperture 154, having the outer surface of the cosmetic mesh 216 flush with the outer contours of the housing can act as acoustic shielding for the microphone to mitigate potential wind noise and improve sound capture quality of the microphone.

The porosity of cosmetic mesh 216 can lend itself to have negligible acoustic impact on sound passing through mesh 215, while having a degree of aesthetic appeal so that its design complements the appearance of the earphone 100. Mesh 216 can include a sidewall surface 216*a* that extends downward from its outer surface into the acoustic opening and surrounding an outer periphery of stiffener 212. In some embodiments, cosmetic mesh 216 can be formed of a stainless steel mesh and can be attached to stiffener 212 via a plurality of laser welding points (e.g., between the sidewall 216*a* of cosmetic mesh 216 and a sidewall of stiffener 212) or by an appropriate adhesive. In some embodiments stiffener 212 can include sidewalls that have one or more portions bending upwards towards the exterior surface of housing 110. When included, such sidewalls can increase the surface area contact with cosmetic mesh 216 to improve mechanical coupling with the cosmetic mesh.

Figure 2B:
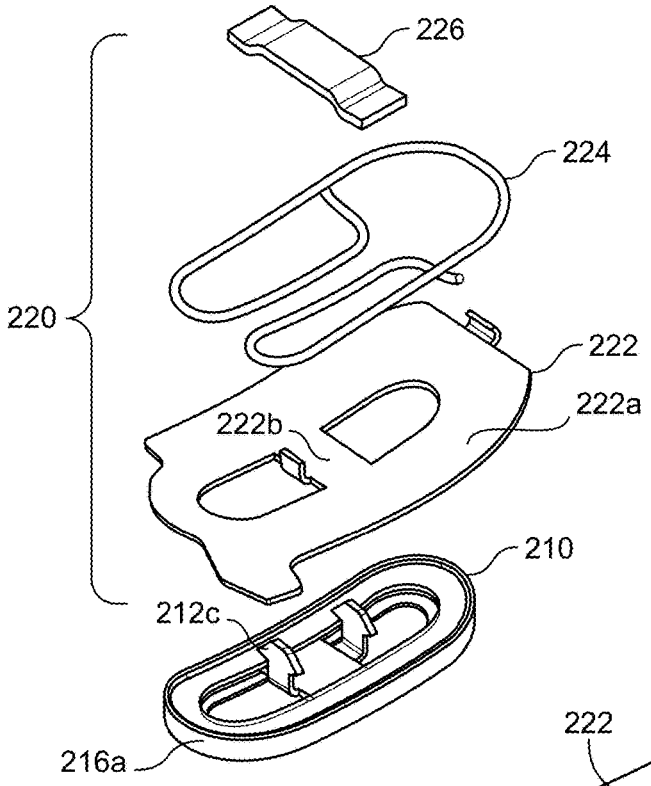
FIG. 2B is an exploded perspective view of the mesh assembly shown in FIG. 2A.

Replaceable assembly 210 can be removably attached to permanent assembly 220 enabling mesh 215 to be easily replaced if the mesh becomes clogged or otherwise damaged. FIG. 2B is a simplified partially exploded illustration of replaceable assembly 210 with its components (stiffener 212, acoustic mesh 214 and cosmetic mesh 216) in an assembled state spaced apart from various components of permanent assembly 220 including a flange 222, a wire form 224 and an attachment element 226. As discussed below with respect to FIGS. 2C and 2D, wire form 224 can latch onto the end tabs 212*c* of stiffener 212 when replaceable assembly 210 is pressed into the permanent assembly 220. Permanent assembly 220 itself can be attached to earphone 100 via an acoustic frame 230. As shown in FIG. 2A, acoustic frame 230 can be positioned within the speaker housing portion 110 of earphone 100. Acoustic frame 230 can define or partially define acoustic chambers within the earphone. For example, in some embodiments acoustic frame 230 can define or partially define the back volume and/or the front volume of the speaker within speaker housing 110. In some embodiments acoustic frame 230 can be formed from a rigid material, such as a hard plastic.

Acoustic frame 230 can also serve as a mounting structure for permanent assembly 220 as well as for a speaker and/or other components of earphones 100. For example, acoustic frame 230 can include a recess 232 (shown in FIG. 2C) formed in an inner surface that is sized and shaped to accept flange 222. The flange 222 can sit within recess 232 and be permanently attached to acoustic frame 230 by, for example, a pressure sensitive adhesive or other appropriate attachment mechanism. Wire form 224 can be positioned adjacent to flange 222 and secured to the flange by attachment element 226.

Figure 2C:
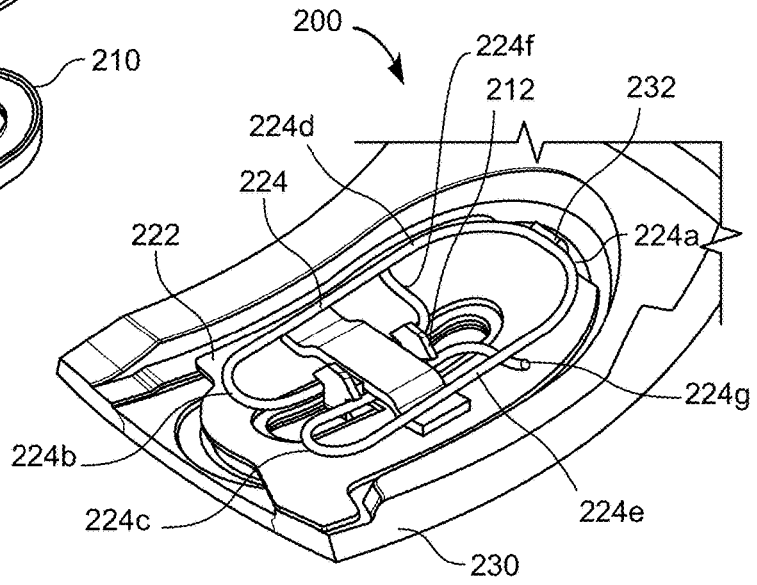
FIG. 2C is a perspective view of the mesh assembly shown in FIG. 2A assembled within an earphone.

Wire form 224 can include a body formed of a single, contiguous strip of wire that is bent in various directions to create a compressible spring that can serve as a latching point for the replaceable assembly 210. For example, as shown in FIG. 2C, which is a perspective view of mesh assembly 200 assembled within acoustic frame 230, wire form 224 can include a u-shaped portion 224*a* at one end and two separate smaller u-shaped portions 224*b* and 224*c* spaced apart from each other at the opposite end. Outer intermediate segments 224*d*, 224*e* can extend between larger u-shaped portion 224*b* and each of the smaller u-shaped portions 224*c*, 224*d*, respectively. Wire form 224 can also include two end segments 224*f*, 224*g* as well as two inner intermediate segments 224*h*, 224*i*. Inner intermediate segment 224*h* can extend between u-shaped portion 224*c* and end segment 224*f* and inner intermediate segment 224*i* can extend between u-shaped portion 224*d* and end segment 224*g*. The arrangement of wire form 224 allows the two inner intermediate signments 224*h*, 224*i* to function as a spring that can latch onto tips 212*c* of rib 200 as discussed below with repsect to FIG. 2D.

Wire form 224 can be secured to flange 222. For example, wire form 224 can be positioned over an inner surface of flange 222 and the flange can include a hook 222*a* at one end that can hook over u-shaped segement 224*a*. Additionally, attachment element 226 can be bonded to flange 222 and extend over inner intermediate segments 224*h*, 224*i* of wire form 224 and under outer intermediate segments 224*d*, 224*e* to further secure the wire form 224 to flange 222. End segments 224*f*, 224*g* can point outwards away from a central axis of wire form 224 towards the outer intermediate segments 224*d*, 224*e* preventing, in combination with hook 222*a*, the wire form from being pulled out of joined flange 222 and attachment 226.

Figure 2D:
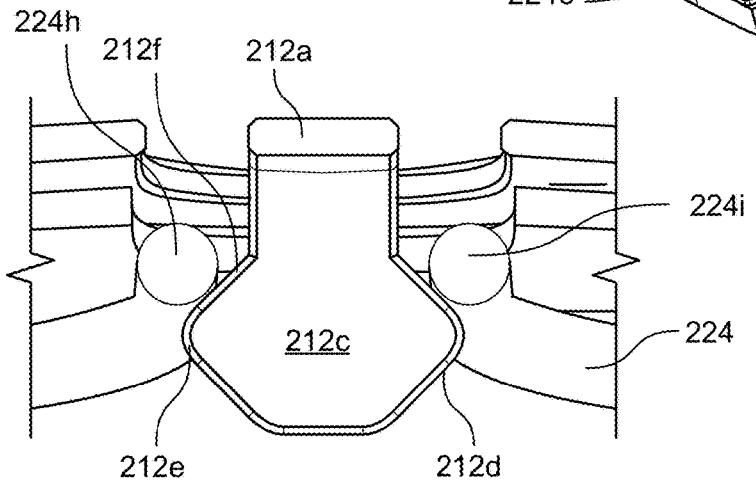
FIG. 2D is a partial perspective view of the mechanical latching mechanism employed in the mesh assembly shown in FIG. 2A.

FIG. 2D is a partial perspective view of replaceable assembly 210 mechanically latching to permanent assembly 220. As shown in FIG. 2D, tabs 212*c* include lower angled surfaces 212*d* and upper angled surfaces 212*f* that join together at a corner 212*e*. When the replaceable assembly 210 is pressed into permanent assembly 220, lower angled surfaces 212*d* contact the inner intermediate segments 224*h*, 224*i* pressing the inner intermediate segments apart until they encounter corners 212*e*. Once the tabs 212*c* are pressed further into the permanent assembly 220, the inner intermediate segments snap inward along upper angled surfaces 212*f* such that wire form spring 224 latches onto the tabs 212*c* securing the replaceable assembly 210 to the permanent assembly 220.

To remove or otherwise replace mesh 215, the replaceable assembly 210 can be pulled away from permanent assembly 220 such that the inner intermediate segments 224*h*, 224*i* are forced apart until they encounter corners 212*e*. Then, once the tabs 212*c* are pulled further away from the permanent assembly 220, the inner intermediate segments snap inward along lower angled surfaces 212*d* allowing the replaceable assembly 210 to be fully removed from the permanent assembly. In some embodiments, replaceable assembly 210 can be pushed into the permanent assembly by a user's finger or a tool with a flat or slightly curved surface that matches the curvature of the earphone housing in which the mesh is included. Replaceable assembly 210 can then be detached from the earphone by a tool that includes one or more small hooks that can latch onto the cosmetic mesh and pull the replaceable assembly off of the earphone.

Figure 3:
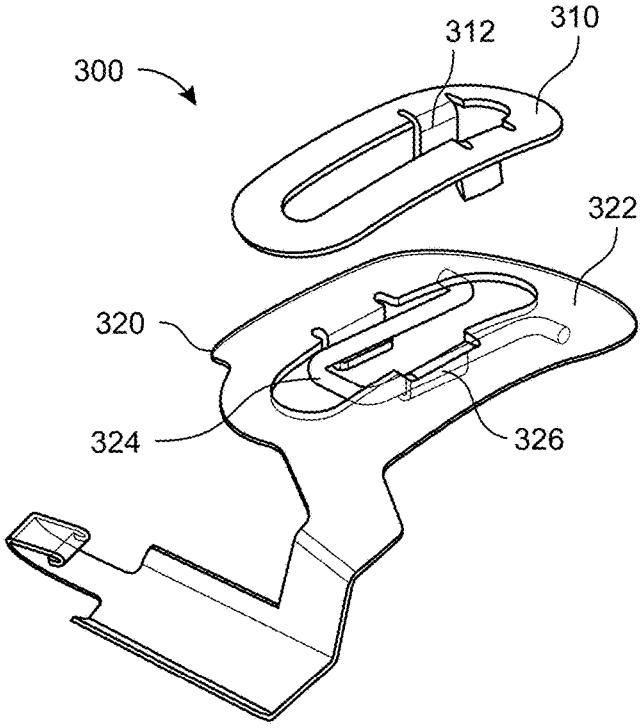
FIG. 3 is a simplified perspective view of selected components of a mesh assembly that can include a replaceable mesh that can be mechanically secured to an earphone in accordance with some embodiments.

FIG. 3 is a simplified perspective view of a mesh assembly 300 in accordance with some embodiments that serve to can protect an audio opening, such as any of the audio openings 150, 152, or 154. Similar to mesh assembly 200, mesh assembly 300 can include a permanent assembly that can be directly or indirectly affixed to an earphone and a replaceable assembly that can be mechanically attached to the permanent assembly in a removable manner. For ease of illustration, mesh assembly 300 is shown without several components including the mesh itself As shown in FIG. 3, mesh assembly 300 includes a stiffener 310, which can be part of a replaceable assembly that includes a single or multi-layered mesh, along with a flange 322 and a wire form 324. Flange 322 and wire form 324 can be part of a permanent assembly that can be permantly affixed to an earphone housing. In some embodiments the permanent assembly can be directly affixed to an acoustic frame, which in turn, can be affixed to the earphone housing.

Flange 322 can include first and second opposing holding elements 326 that extend downward (i.e., away from the audio opening in the earphone housing that mesh 300 protects) from within a central opening of the flange 322. Each of the holding elements 326 can include a shelf 326*a* that projects inward towards the opposing holding element. Similar to wire form 224, wire form 324 can include a body formed of a single, contiguous strip of wire that is bent in various directions to create a compressible spring that can serve as a latching point for the replaceable assembly stiffener 312. Wire form 324 can site on the shelves 326*a* and can include first and second opposing arms 324*a* along with first and second end members 324*b*. Each of the end members 324*b* can extend away from one of the arms and include a section extending away from the other end member. When mesh assembly 300 is fully assembled, the end members 324*b* can be pressed up against an inner surface of flange 322. While not shown in FIG. 3, flange 322 can include hooks that each of the end members 324*a* fits within to secure the end members to the flange.

Stiffener 310 can include first and second tabs 312 that have a length that extends downward (i.e., away from the audio opening that mesh assembly 300 protects). Each of the tabs 312 can have a concave shape such that a portion of each tab 312 is closest to the opposing tab at a location along the length of the tab between an upper surface 310*a* of stiffener 310 and a distal end 312*b* of each tab 312. When the stiffener 310 is pressed into flange 322, tabs 312 contact wire form 324 forcing the two arms of the wire form apart until they latch onto the tabs when the narrowest portion of the concave tabs extends below the wire form 324.

Figure 4:
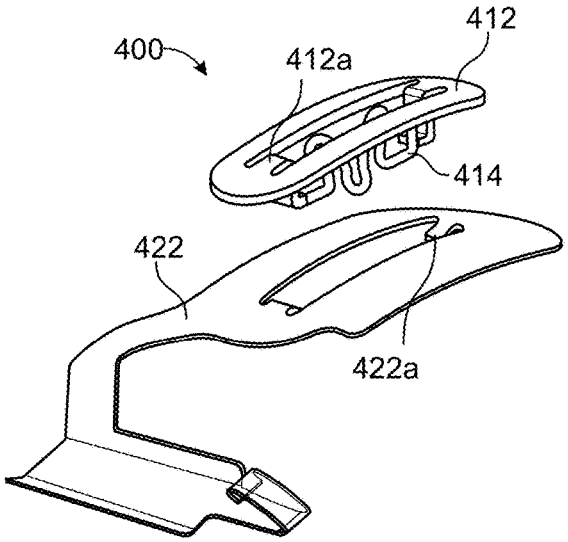
FIG. 4 is a simplified perspective view of selected components of a mesh assembly that can include a replaceable mesh that can be mechanically secured to an earphone in accordance with some embodiments.
Figure 5:
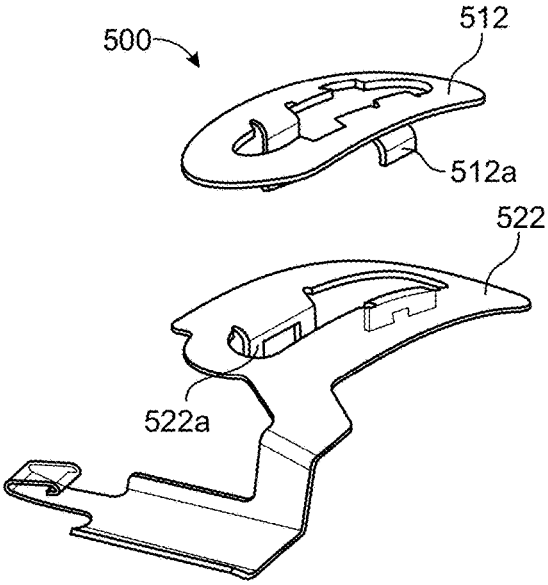
FIG. 5 is a simplified perspective view of selected components of a mesh assembly that can include a replaceable mesh that can be mechanically secured to an earphone in accordance with some embodiments.

FIGS. 4 and 5 are simplified perspective views of mesh assemblies 400 and 500, respectfully, that can be mechanically secured to an earphone in accordance with additional embodiments. Similar to FIG. 3, the mesh assemblies 400 and 500 can each include a replaceable assembly and a permanent assembly, but for ease of illustration, the mesh assemblies are shown without several components of such assemblies including the mesh itself Mesh assembly 400 can include a stiffener 412 that can be removably attached to a flange 422. Stiffener 412 can include two tabs 412*a* at opposing ends of the stiffener and a wire form spring 414 can extend between the two tabs exerting a force that pushes the tabs away from each other. Flange 422 can include first and second tabs 422*a* at opposing ends of an opening defined by the flange that align with tabs 412*a*. The stiffener tabs 412*a* can be press fit within tabs 422*a* with wire form spring 414 mechanically securing the fit.

Mesh assembly 500 can include a stiffener 512 that can be removably attached to a flange 522. Instead of including a wire form spring, stiffener 512 includes first and second tabs 512*a* can be press fit within openings formed in corresponding tabs 522*a* of flange 522.

Adhesively Attached Meshes

Figure 6A:
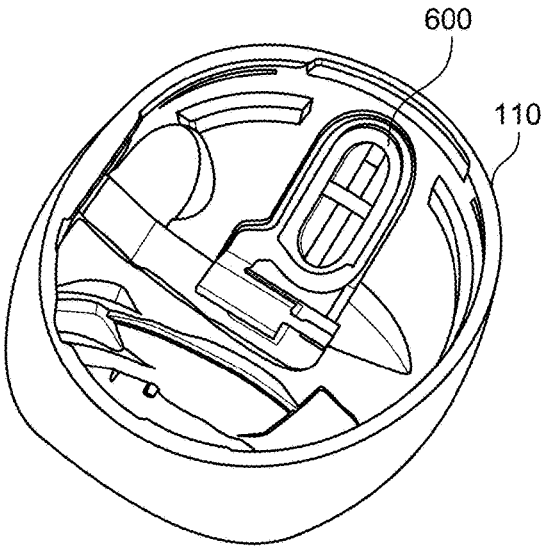
FIG. 6A is a simplified view of a mesh assembly, as viewed from the interior cavity of the earphone, that can include a replaceable mesh that can be adhesively secured to an earphone in accordance with some embodiments.
Figure 6B:
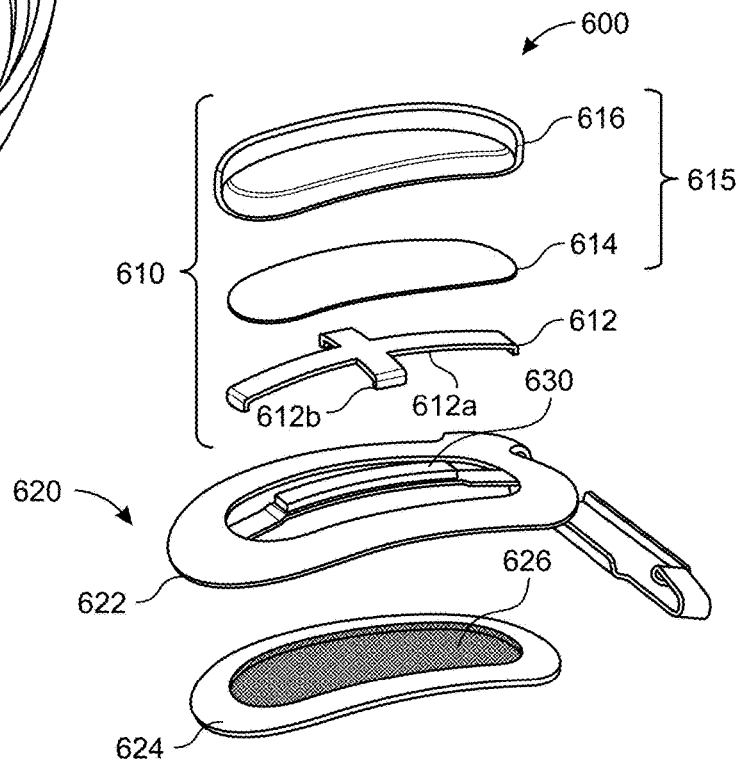
FIG. 6B is an exploded perspective view of the as viewed from the interior cavity of the earphone shown in FIG. 6A.
Figure 6C:
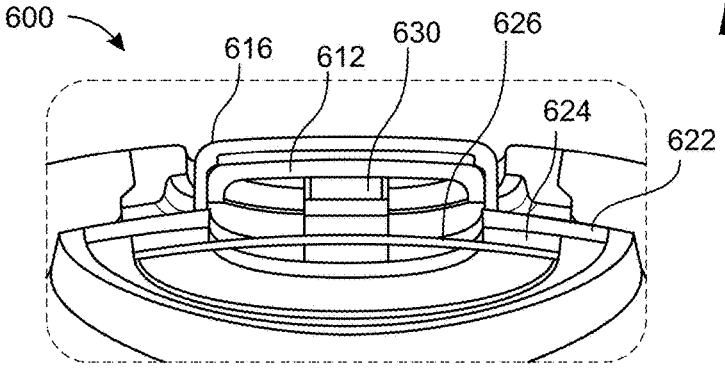
FIG. 6C is a partial side perspective view of the as viewed from the interior cavity of the earphone shown in FIG. 6A attached to an earphone.

Reference is now made to FIGS. 6A-6C in which FIG. 6A is a simplified view of a mesh assembly 600 that can include a replaceable assembly that can be adhesively secured to an earphone in accordance with some embodiments as viewed from the interior cavity of a speaker housing 110, FIG. 6B is an exploded perspective view of the mesh assembly 600, and FIG. 6C is a partial side perspective view of the mesh assembly 600 attached to an earphone. Similar to mesh assembly 200, mesh assembly 600 includes a replaceable assembly 610 and a permanent assembly 620. The permanent assembly 620 can be positioned within a recess or cutout on an interior surface of speaker housing 110 that is sized and shaped to accept a flange portion 622 of the permanent assembly 620. Replaceable assembly 610 can be removably coupled to the permanent assembly 620 so that if its mesh gets clogged or otherwise damage, the replaceable assembly 610 can be detached from the permanent assembly 620 and replaced with a new replaceable assembly.

The replaceable assembly 610 can include a stiffener 612 and a mesh 615 and can be adhesively coupled to flange 622 by a debondable conductive adhesive 630 such as a conductive debondable PSA. Stiffener 612 can provide structural integrity to the replaceable assembly and in various embodiments can be made out of a metal (e.g., stainless steel), hard plastic or other suitable rigid material. In the embodiment depicted in FIGS. 6A-6C, stiffener 612 is a cross-shaped structure that includes a first central rib 612*a* and a second rib 612*b* that bisects and is perpendicular to the first rib. The first and second ribs 612*a* and rib 612*a* can include contours that conform to the topography of the external surface of housing 110.

Mesh 615 can be positioned over an acoustic opening, such as any of openings 150, 152, 154, to prevent debris and other unwanted particles from falling into the housing through the acoustic opening. Mesh 615 can be similar to mesh 215 described above and can include an acoustic mesh 614 (e.g., a mesh that catches earwax) sandwiched between stiffener 612 and a cosmetic mesh 616. The acoustic mesh 614 and cosmetic mesh 616 can be similar to the acoustic and cosmetic meshes 214 and 216 described above.

Replaceable assembly 610 can be removably attached to permanent assembly 620 by adhesive 630. The adhesive 630 can essentially secure replaceable assembly 610 to the earphone 600 with a sufficient adhesive force that the replaceable assembly 610 cannot be detached during normal operation and use of earphone 100. If the replaceable mesh 615 becomes clogged or otherwise needs to be replaced, however, debondable adhesive 630 can be exposed to a treatment step that greatly reduces the adhesion between replaceable assembly 610 and permanent assembly 620 allowing the replaceable mesh to be removed. In some embodiments adhesive 630 can be an electrically conductive adhesive that can be debonded by exposing the adhesive to a sufficiently high voltage. Once exposed, the replaceable assembly 610 can be removed and a new replaceable assembly 610 with a new mesh 615 can be attached to flange 630.

In some embodiments, mesh assembly 600 can further include a second acoustic mesh 626 coupled to flange 622 by a second pressure sensitive adhesive or other appropriate mechanism. Acoustic mesh 626 can be coupled to the opposite side of permanent assembly 620 that replaceable mesh 615 is coupled to. Mesh 615 includes an earwax catching mesh 614 that prevents material that might otherwise clog a mesh from reaching acoustic mesh 626 enabling mesh 626 to be, essentially, a permanently installed acoustic mesh that is not replaced when replaceable assembly 610 is detached from earphone 100.

Figure 7A:
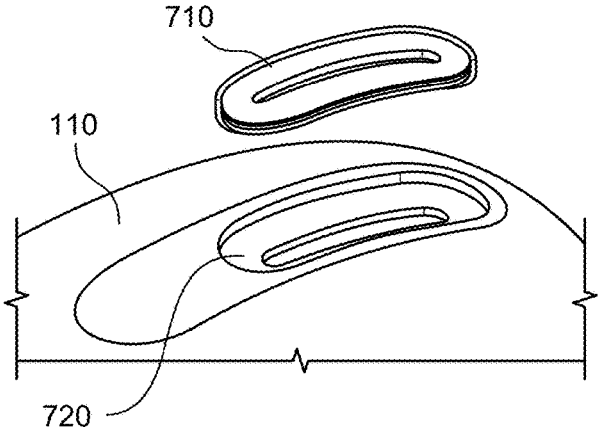
FIG. 7A is a perspective view of a mesh assembly as viewed from the interior cavity of the earphone that can include a replaceable mesh that can be adhesively secured to an earphone in accordance with some embodiments prior to attachment to the earphone.
Figure 7B:
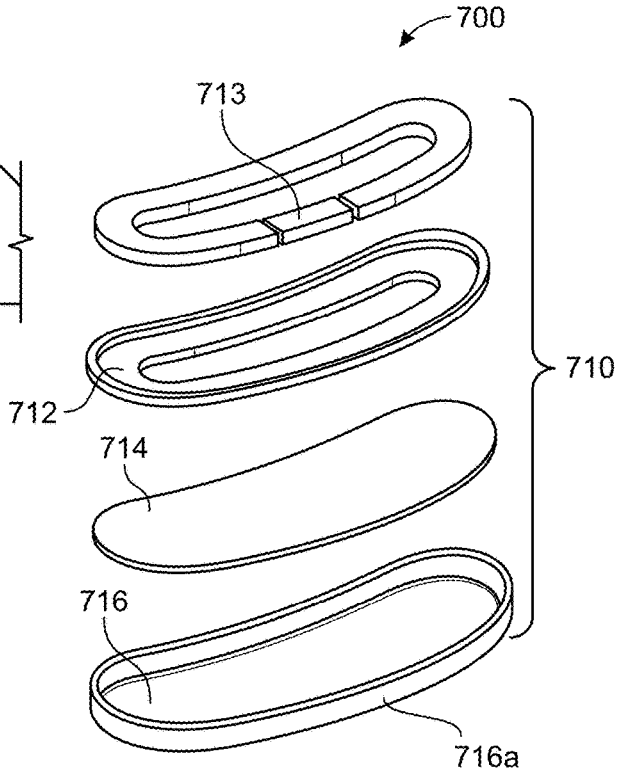
FIG. 7B is an exploded perspective view of a portion of the mesh assembly shown in FIG. 7A.

FIG. 7A is a perspective view of a mesh assembly 700 that can be adhesively secured to an earphone in accordance with some embodiments. Similar to mesh assembly 200, mesh assembly 700 can include a replaceable assembly 710 and a permanent assembly 720. FIG. 7A depicts replaceable assembly 710 in a spaced apart relationship from permanent assembly 720 which is affixed to an earphone housing 110 prior to attachment of the mesh assembly 700 to the earphone 100. As shown in FIG. 7B, which is an exploded perspective view of replaceable assembly 710, the replaceable assembly can include a stiffener 712, a mesh 715 and an adhesive layer 718. Mesh 715 can be a multilayer mesh and include an acoustic mesh 714 and a cosmetic mesh 716. The acoustic mesh 714 and cosmetic mesh 716 can be similar to the acoustic and cosmetic meshes 214 and 216 described above.

Stiffener 712 can be made from a rigid material such as a metal or hard plastic and can include a lip that around an outer periphery of the stiffener. Adhesive layer 718 can have an annular oval shape and fit within the lip of stiffener 712. The adhesive layer 718 can include a pressure sensitive adhesive segment 718*a* extending along a portion of the annular layer and a conductive PSA segment 718*b* abutting the adhesive segment 718*a* and extending along a remainder of the annular layer. When stiffener 712 is made from a conductive metal or similar material, the conductive PSA region 718 can provide a ground path from the cosmetic mesh 715 through the stiffener 712 and the conductive PSA region 718*b* to an underlying flange 720 that the adhesive layer 718 is adhered to.

Figure 7C:
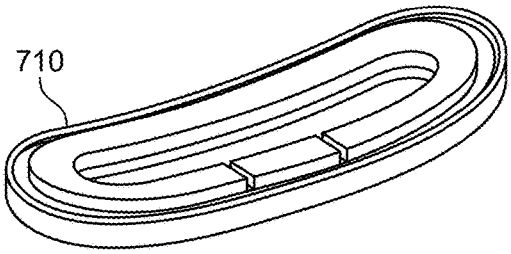
FIG. 7C is a bottom perspective view of a portion of the mesh assembly shown in FIG. 7A.
Figure 7D:
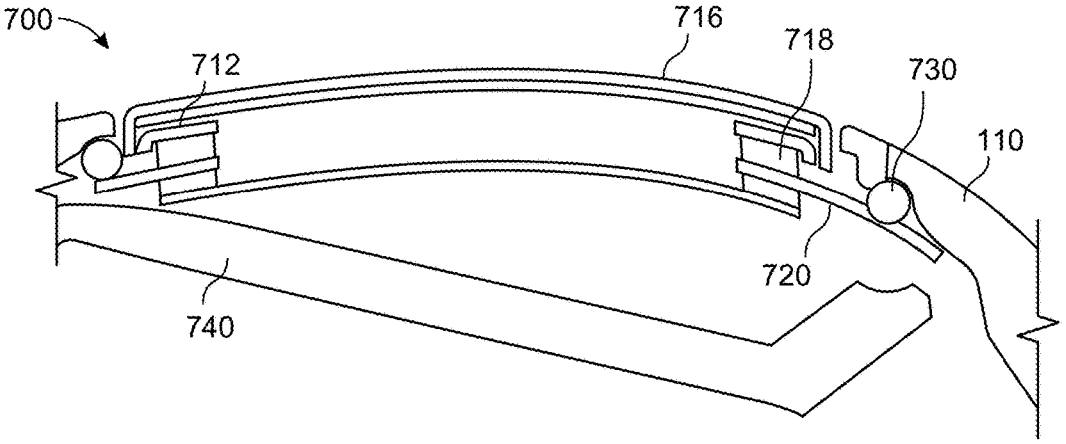
FIG. 7D is a simplified side view of the mesh assembly shown in FIG. 7A attached to an earphone.

FIG. 7C is a bottom perspective view of the replaceable assembly 710. As shown in FIG. 7C, the cosmetic mesh 716 can include a sidewall 716*a* that wraps around the components of the replaceable assembly 710. FIG. 7D is a simplified side view of the mesh assembly 700. As shown in FIG. 7D, an o-ring 730 can be disposed between a flange 722 that is a component of permanent assembly 720 and an interior surface of the wall of housing 110 providing a seal around the region of housing 110 in which the mesh assembly 700 is attached to prevent the ingress of liquid (such as water, sweat or other moisture) and debris into the speaker housing.

Magnetically Attached Meshes

Figure 8A:
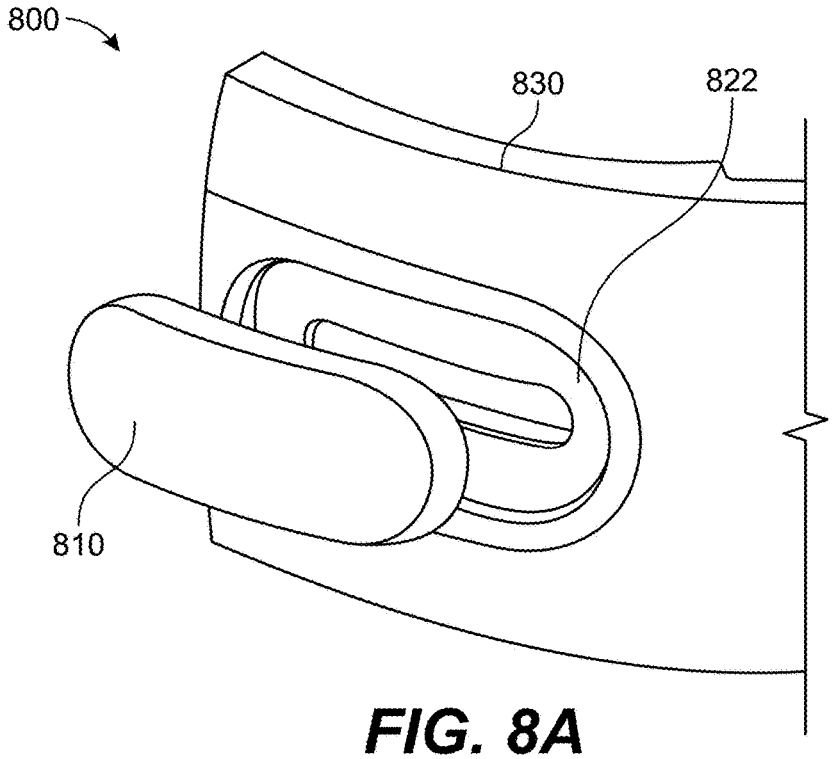
FIG. 8A is a perspective view of a mesh assembly that includes a replaceable mesh that can be magnetically secured to an earphone in accordance with some embodiments prior to attachment to an earphone.
Figure 8B:
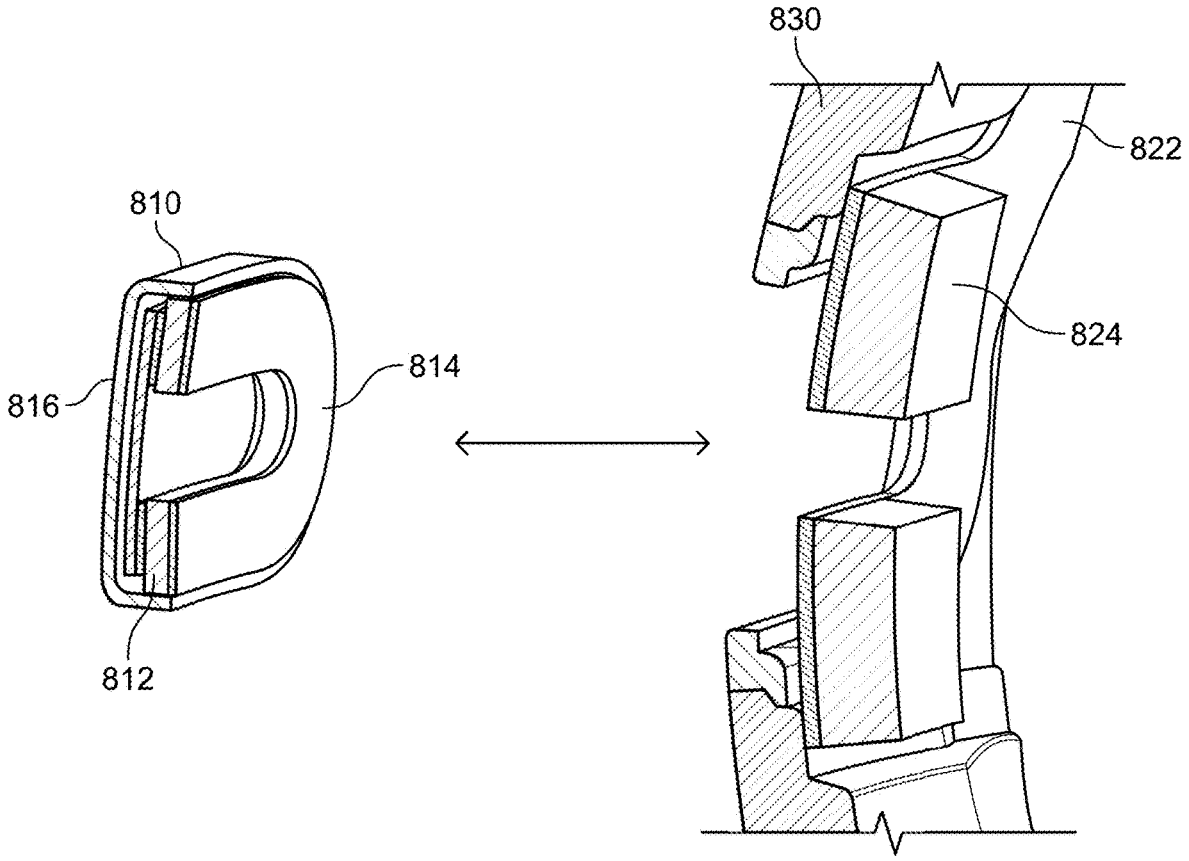
FIG. 8B is a cross-sectional perspective view of the mesh assembly shown in FIG. 8A prior to attachment to the earphone.

Reference is now made to FIGS. 8A and 8B. FIG. 8A is a perspective view of a mesh assembly 800 that can be magnetically secured to an earphone in accordance with some embodiments and FIG. 8B is a cross-sectional perspective view of mesh assembly 800. Mesh assembly 800 can include a replaceable assembly 810 and a permanent assembly 820. Each of FIGS. 8A and 8B depict the replaceable assembly 810 in a spaced-apart relationship with permanent assembly 820 prior to the attachment of the replaceable assembly 810 to the permanent assembly. When mesh assembly 800 is fully assembled and coupled to housing 110, a mesh 815 of the assembly can be positioned over an acoustic opening 850 of the housing to prevent debris and other unwanted particles from falling into the housing through the acoustic opening. Acoustic opening 850 can be any acoustic opening formed through housing 110, such as one of openings 150, 152 or 154 described above.

Replaceable assembly 810 can include a base plate 812, a mesh 815 and a seal 812. Base plate 812 can be made from a relatively rigid magnetic material that provides structural integrity to the replaceable assembly 810 and enables the assembly 810 to be magnetically secured to the permanent assembly 820. In some embodiments, base plate 812 can be made out of ferromagnetic steel. Mesh 815 can be an interlaced structure formed of a network of wire that allows sound to propagate through the mesh but prevents debris from passing through. In the embodiments depicted in FIGS. 8A and 8B, mesh 815 can be a multilayer mesh that includes an acoustic mesh 814 and a cosmetic mesh 816 that can be similar to acoustic and cosmetic meshes 214, 216 discussed above. Seal 812 can be a layer of foam, silicone or similar compressible material that forms a seal between replaceable member 810 and permanent member 820 to prohibit the ingress of water or other moisture and/or dust or other debris from entering into the earphone housing around mesh assembly 800 and through opening 850.

Permanent assembly 820 can include a flange 822 and one or more magnets 824. The flange 822 can couple the permanent assembly 820 to an acoustic housing (as shown in FIG. 8A or 8B) or, in other embodiments, directly to the housing 110 of an earphone. Magnets 824 can be adhesively secured to flange 822 and positioned to magnetically couple with base plate 812 when replaceable assembly 810 is positioned within the opening 850. Magnets 824 can be selected to generate a sufficiently strong magnetic field to secure base plate 812 during normal operation and during a drop event or similar impact event while still enabling the replaceable assembly to be removed from the earphone when replacement is desired. In some embodiments magnets 824 can be electropermanent magnets that are activated prior to or upon initial installation of the replaceable assembly to secure the replaceable assembly 810 to the permanent assembly 820. Then, when the replaceable assembly is to be removed, the electropermanent magnet can be energized to switch the direction of magnetization enabling the replaceable assembly to be easily detached.

Representative applications of methods and apparatus according to the present application were described above. The various examples described above are provided solely to add context and aid in the understanding of the described embodiments. It will thus be apparent to one skilled in the art that the described embodiments may be practiced without some or all of these specific details. In other instances, well known process steps have not been described in detail in order to avoid unnecessary obscuring the described embodiments. For example, various aspects, embodiments, implementations or features of the described embodiments can be used separately or in any appropriate combination. Also, other applications are possible, such that the following examples should not be taken as limiting.

Snorkel Meshes

Figure 9A:
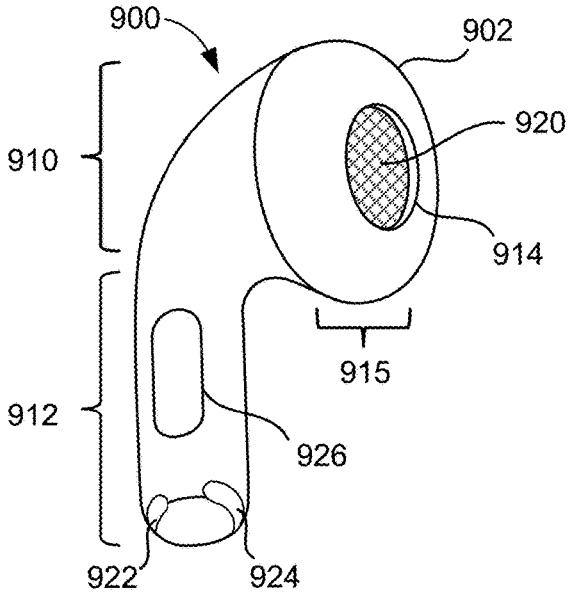
FIGS. 9A-9C are simplified views of a portable wireless earbud according to some embodiments.
Figure 9B:
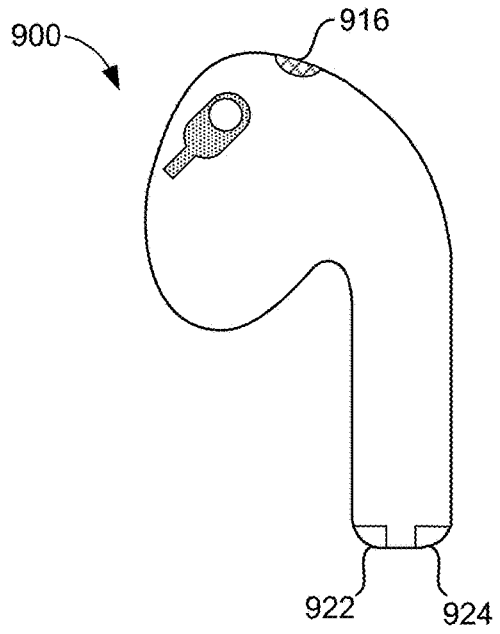
Figure 9C:
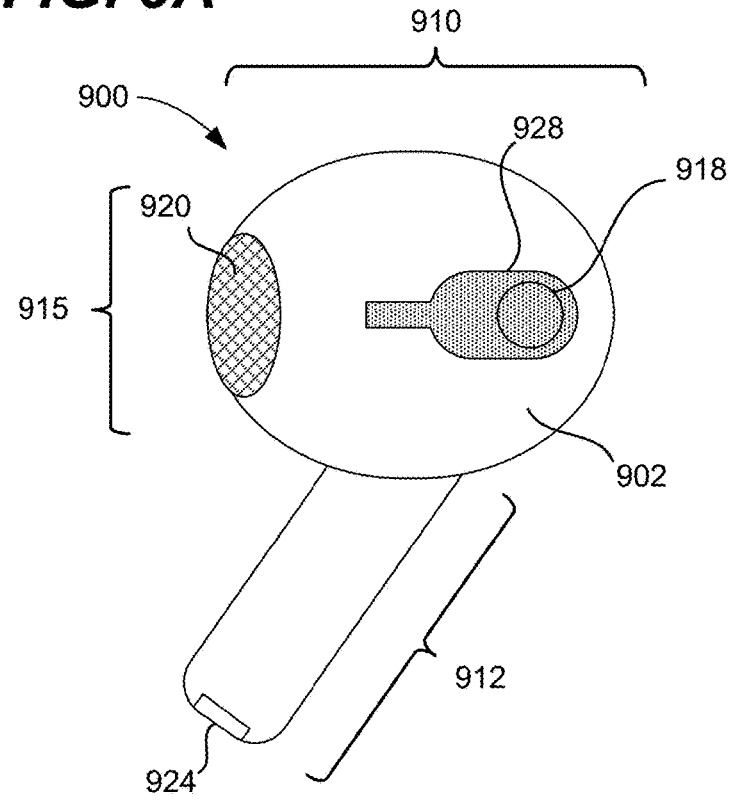

As noted above, various embodiments of replaceable meshes described herein can be useful for both earbuds as well as in-ear headphones. As an example, reference is now made to FIGS. 9A-9C, which are simplified views of a wireless earbud 900 according to some embodiments. Specifically, FIG. 9A is a simplified plan view of a first side of earbud 900, FIG. 9B is a simplified plan view of a second side, opposite the first side, of earbud 900, and FIG. 9C is a simplified top view of earbud 900.

Earbud 900 includes a housing 902 that can be made from, for example, a hard radio frequency (RF) transparent plastic such as acrylonitrile butadiene styrene (ABS) or polycarbonate. In some embodiments, housing 902 can be made from one or more components that can be bonded together (e.g,. with tongue and groove joints and an appropriate adhesive) to form a monolithic housing structure with a substantially seamless appearance. Housing 902 forms a shell that defines an internal cavity in which the various components of earbud 900 are housed. As depicted housing 902 includes two primary sections: a speaker housing 910 and a stem 912 that protrudes away from the speaker housing at an angle. The cavity portion within speaker housing 910 can hold an audio driver and battery while the cavity portion within stem 912 can hold a primary circuit board and other electronics. In some embodiments, stem 912 can also include electrical contacts 922, 924 at the distal tip of the stem. Electrical contacts 922, 924 provide a physical interface that can be electrically coupled with corresponding electrical contacts in a corresponding charging case.

Earbud 900 can be configured to have an open, unsealed acoustic architecture that is sometimes referred to as a "leaky acoustic architecture". That is, earbud 900 does not include a deformable ear tip that is included on the in-ear headphone 100 discussed above (e.g., ear tip 120). Instead, speaker housing 910 can be sized and shaped to fit within a user's ear without being inserted into the ear canal and all acoustic air volumes within earbud 900 have a free flowing air path to the ambient.

Speaker housing 910 is the primary support mechanism for earbud 900 when the earbud is positioned within a user's ear and speaker housing 910 can be shaped to rest between a user's tragus and anti-tragus without putting unwanted pressure on the crus helix, which could lead to a source of discomfort when the earbud is engaged in a user's ear for a long period of time. Towards this end, in some embodiments speaker housing 910 can be contoured to include an end portion 915 at its distal end that allow the speaker housing portion to sit deep within the space between the tragus and anti-tragus of a user's ear. End portion 915 is sometimes referred to as a snorkel and, in some embodiments, can form a pseudo seal (sometimes referred to as a passive seal) between the housing and user's ear even though earbud 900 is not an in-ear headphone and does not include a deformable ear tip that is inserted into the user's ear canal. The pseudo seal allows earbud 900 to have improved audio quality compared to other leaky architecture earbuds without creating potential pressure build-up within a user's ear that can be created by earbuds with deformable ear tips and that some user's find uncomfortable.

Speaker housing 910 can be further contoured such that certain surfaces of the housing are not in contact with any portion of an average user's ear. These non-contact portions provide locations for various features of earbud 900 including audio ports, such as a primary acoustic port 914, a base port 916 and a control leak 918. Acoustic port 914 provides an acoustic pathway for sound generated by an audio driver (not shown in FIGS. 9A-9C) within speaker housing 910 to reach a user's ear canal through the snorkel portion 915. Base port 916 can be an opening in speaker housing 910 that provides an acoustic pathway from the driver that allows air to flow easier within the acoustic pathway for low frequency sounds, e.g., bass sound waves that are lower than 20 Hz. Similarly, control leak 918 can be an opening within speaker housing 910 that allows air to flow out of housing 902, however, instead of improving bass sound quality, control leak 918 can provide an atmospheric pass-through between an outside environment and acoustic port 914 when earbud 900 is worn by a user so that speaker housing 910 does not completely seal the ear canal and trap pressure within the ear canal.

Some or all of the audio ports 914, 916 and 918 can include a replaceable mesh according to embodiments described herein over the port to prevent foreign objects from reaching, contacting or damaging the components disposed behind the covered audio port. As examples, control leak 918 can be covered by an acoustic mesh 928 and acoustic port 914 can include a mesh 920 that, because acoustic port 914 is formed through the snorkel portion 915 of earbud 900, can be referred to as a snorkel mesh 920.

Figure 10A:
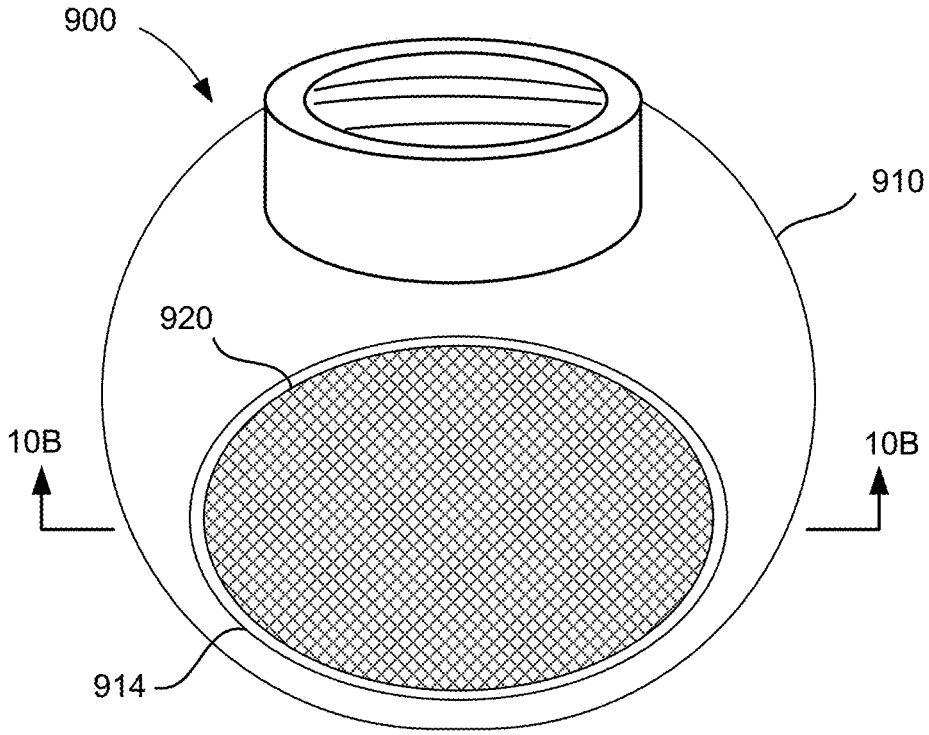
FIG. 10A is a simplified partial view of an earbud according to some embodiments.
Figure 10B:
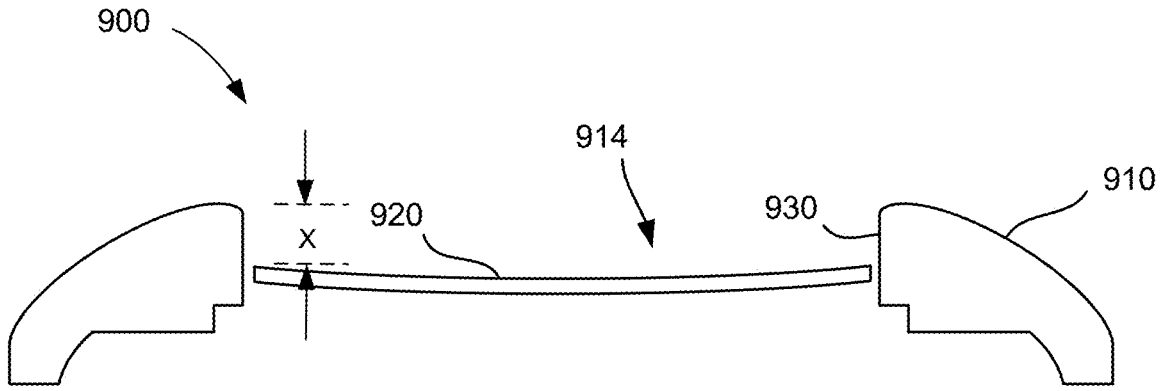
FIG. 10B is a simplified cross-sectional view of the earbud shown in FIG. 10A.

An embodiment of earbuds 900 that includes a snorkel mesh 920 is shown in FIGS. 10A and 10B where FIG. 10A is a simplified partial view of an earbud 900 (without stem 912) looking towards acoustic port 914 and FIG. 10B is a simplified cross-sectional view of earbud 900 taken through acoustic port 914. As shown in FIG. 10B, acoustic port 914 can be formed as a cutout through speaker housing 910 such that the size and shape of acoustic port 914 is defined by an inner, annular surface of a wall 930 of the speaker housing.

Figure 10C:
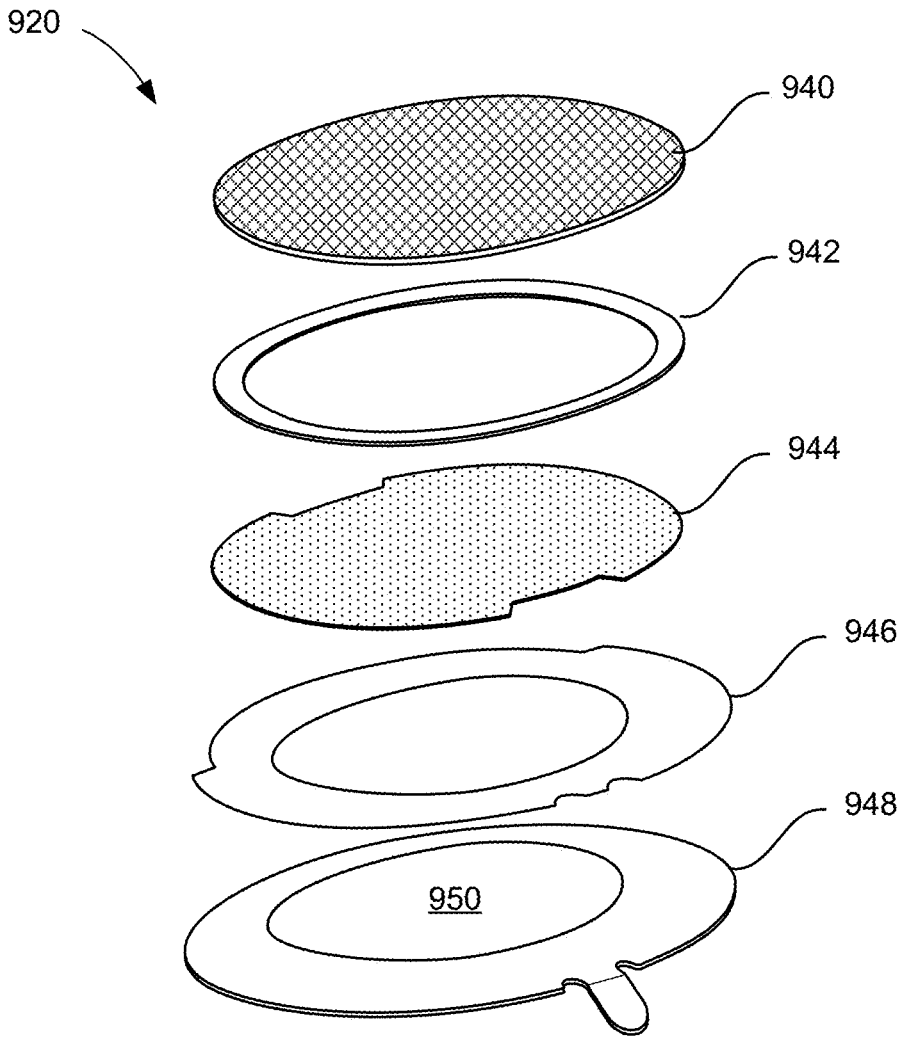
FIG. 10C is a simplified exploded view of a multi-layer snorkel mesh that can be included in the earbud of FIGS. 10A and 10B.

Snorkel mesh 920 can be coupled to speaker housing 910 by a support component (not shown in FIG. 10B) and can sit within the acoustic port and within the edges of wall 930 such that snorkel mesh 920 spans across the entirety of acoustic port 914. In some embodiments, mesh 920 can include multilayer, distinct layers, each of which serves a different purpose. For example, as shown in FIG. 10C, which is a simplified exploded view of mesh 920, the snorkel mesh can be formed as a multi-layered structure including a cosmetic mesh 940 and an acoustic mesh 944 where the cosmetic mesh forms an outer surface of earbud 900 while the acoustic mesh is positioned within acoustic port 914 beneath the cosmetic mesh. As a specific non-limiting example, the cosmetic mesh can be formed of interlaced stainless steel and the acoustic mesh can be formed of a porous fabric, such as polyester. A supporting frame (also referred to as a stiffener) 948 made out of a rigid material can provide additional structure to the mesh 920 and can define an opening 950 that aligns with acoustic port 914. Acoustic mesh 944 can be adhered to stiffener 948 by an adhesive 946. Similarly, cosmetic mesh 940 can be adhered to acoustic mesh 944 by an adhesive 942. In some embodiments, one or both of adhesives 942, 946 can be a thin flexible pressure sensitive adhesive (PSA) layer.

Because earbuds are worn directly in a user's ear, earbuds are susceptible to a build-up or collection of ear wax that can collect on within the acoustic port between a speaker driver and a user's ear canal. Such wax build-up can cover a portion of the snorkel mesh 920 and can muffle or otherwise adversely impact the sound quality of an earphone.

Referring back to FIG. 10B, to reduce ear wax build-up, in some embodiments snorkel mesh 920 is recessed within acoustic port 914 such that snorkel mesh 920 is spaced a distance X from the opening at the exterior surface of speaker housing 910 in order to space the mesh further away from a user's ear. In some embodiments, X can be between 0.3 and 2.0 mm and in some embodiments X can be between 0.5 and 1.0 mm. In the embodiment depicted in FIG. 10B, mesh 920 is shown as having a concave profile in which the center of mesh 920 is recessed further within acoustic port 914 than the outer edges of mesh 900. In some embodiments, however, mesh 920 can be substantially planar or have a convex shape in which the center of mesh 920 is still recessed within acoustic port 914 but is recessed less than the outer edges of mesh 920.

In some embodiments, snorkel mesh 920 can be a replaceable mesh such that, if ear wax build-up on the mesh occurs and reaches an undesirable amount, the snorkel mesh 920 with wax build up on it can be replaced with a new snorkel mesh 920 without any wax build up. For example, the entire snorkel mesh structure 920 can be a replaceable assembly that can be removably attached to a permanent assembly (e.g., a support component) that is bonded to or otherwise affixed to or a part of the speaker housing 910 in the area of the acoustic port. Various, non-limiting examples of a replaceable snorkel mesh are described below with respect to FIGS. 11A to 14D.

Figure 11A:
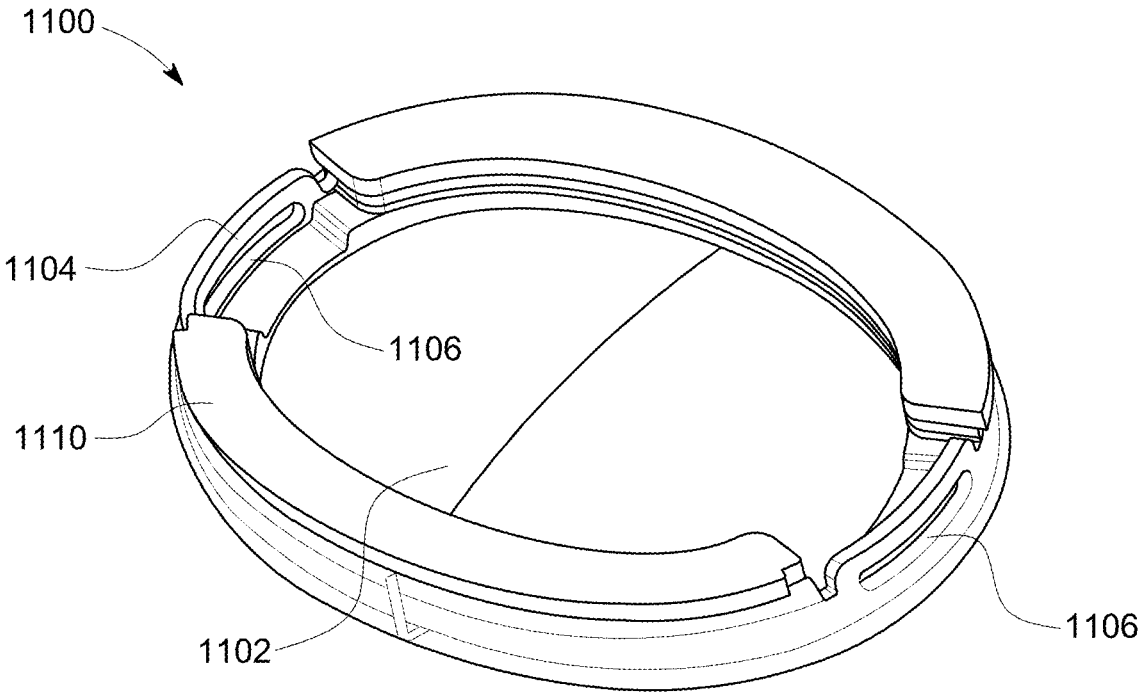
FIG. 11A is a simplified perspective view of a replaceable mesh according to some embodiments.
Figure 11B:
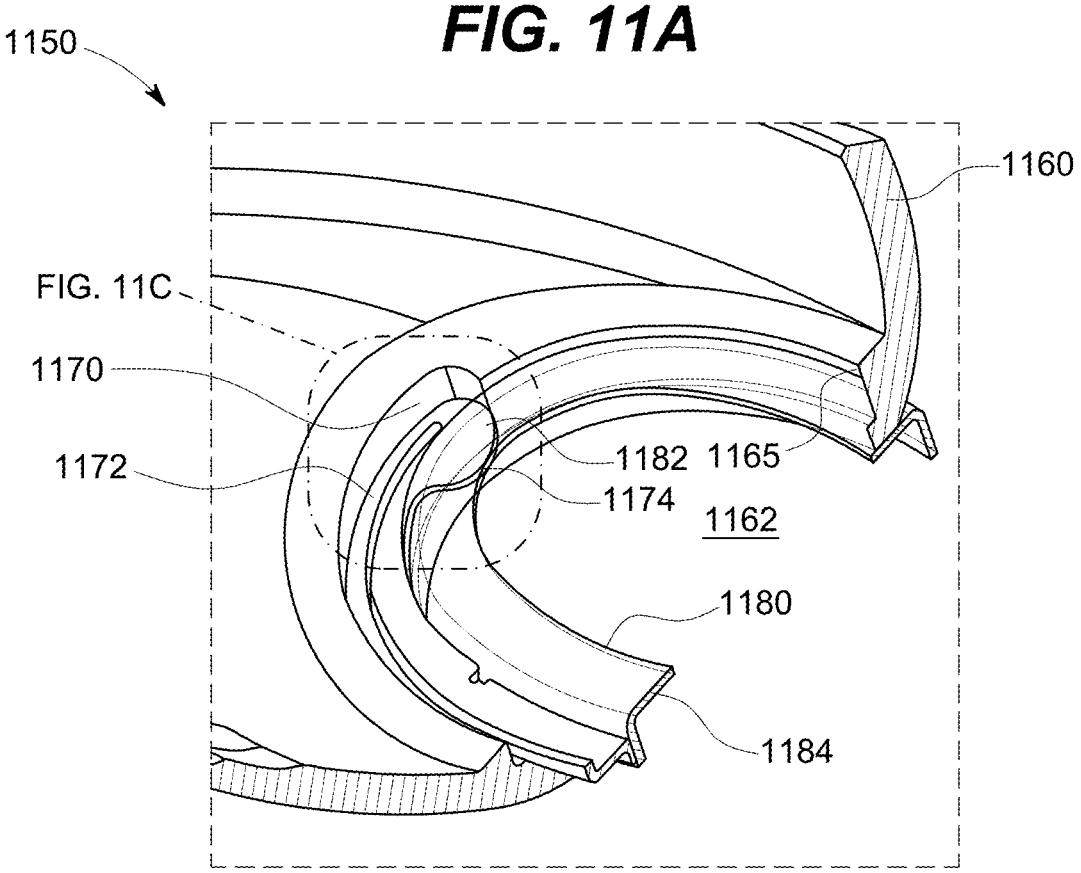
FIG. 11B is a simplified perspective view of a portion of speaker housing within an earbud according to some embodiments.

Reference is now made to FIGS. 11A and 11B where FIG. 11A is a simplified perspective view of a replaceable mesh assembly 1100 according to some embodiments, and FIG. 11B is a simplified perspective view of a portion of a permanent assembly 1150 coupled to speaker housing 1160 of an earbud, such as earbud 900, according to some embodiments. As shown in FIG. 11A, replaceable mesh assembly 1100 can include a multilayer mesh 1102 attached to a frame 1104. A pair of openings 1106 can be formed on the opposing sides of frame 1104. In some embodiments multilayer mesh 1102 can include an outer cosmetic mesh and an acoustic mesh as described above with respect to FIG. 10C.

As shown in FIG. 11B, speaker housing 1160 can include an annular wall 1165 that defines an acoustic opening 1162 that can be, for example, similar to acoustic opening 914. A channel 1170 (only a portion of which is visible in FIG. 11B) can be formed within the speaker housing 1160 and extend between opposite ends of acoustic opening 1162. Permanent assembly 1150 can include first and second springs 1172 formed in each channel 1170 (only one of which is shown in FIG. 11B) and an annular snap frame 1180. Each of the first and second springs 1172 can include a finger 1174 disposed at its distal end. In some embodiments, channel 1170 can be a single u-shaped channel that extends along approximately half the length of annular wall 1165 and the first and second springs 1172 can be disposed at opposite ends of a single u-shaped component that fits within and is adhered to channel 1170. Annular snap frame 1180 can be fitted within annular wall 1165 and coupled to speaker housing 1160. Snap frame 1180 can include first and second openings 1182 at opposing ends of the frame and each spring 1172 biases its respective finger 1174 so that the finger extends through its corresponding opening 1182.

Figure 11C:
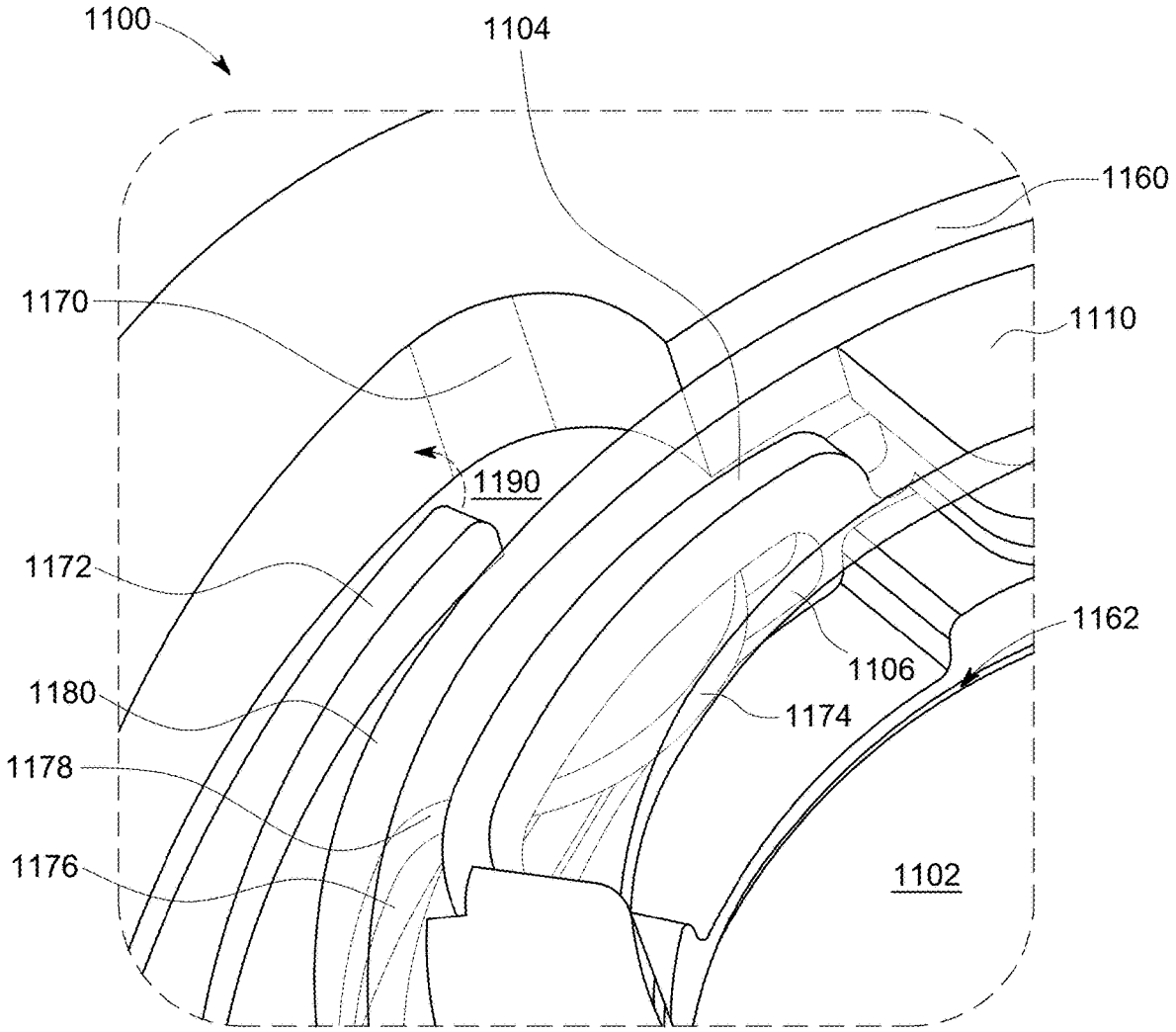
FIG. 11C is a simplified and expanded perspective view illustrating the interaction of the replaceable mesh 1100 shown in FIG. 11A with the speaker housing 910 shown in FIG. 11B according to some embodiments.

FIG. 11C is a simplified and expanded perspective view illustrating the interaction of replaceable mesh assembly 1100 shown in FIG. 11A with permanent assembly 1150 shown in FIG. 11B according to some embodiments. As shown in FIG. 11C, when replaceable mesh 1100 is fully inserted into opening the acoustic port 1162, opening 1106 in the replaceable mesh frame 1104 aligns with finger 1174 of the spring 1172. Spring 1172 biases finger 1174 such that it extends through opening 1182 and through opening 1106 locking the replaceable mesh assembly 1100 to speaker housing 1150. While FIG. 11C illustrates the interaction between spring 1172 and opening 1106 at one end of the replaceable mesh assembly 1100, the equivalent attachment features at opposite end of the replaceable mesh assembly, which is not shown in FIG. 11C, operate in essentially the same manner.

In the embodiment depicted in FIGS. 11A-11C, a custom tool can be used to attach and deattach the replaceable mesh assembly from the speaker housing. For example, the tool can be inserted into a channel 1176 between the snap frame 1180 and frame 1104 of the replaceable mesh assembly at each end and slid towards finger 1174. As the tool contacts curved region 1178, it can compress finger 1174 and spring 1172 away from opening 1106 in direction 1190 as indicated by the dashed line in FIG. 11C. Replaceable mesh assembly 1100 can then be inserted within acoustic opening 1162 and when the tool is removed, springs 1172 push fingers 1174 through openings 1106 locking the replaceable mesh assembly in place. The custom tool can then also be used to remove the replaceable mesh assembly from the speaker housing in essentially the same manner.

In some embodiments, replaceable mesh assembly 1100 can further include an adhesive layer 1110 along a bottom surface of frame 1104 that aligns with ledge 1184 of snap frame 1180 to adhesively bond the replaceable mesh assembly to the snap frame.

The embodiment shown in FIGS. 11A-11C included spring fingers that were permanently affixed to the speaker housing of earbud 1150. In some embodiments, spring fingers can instead be included on the replaceable mesh assembly. One example of such an embodiment is shown in FIGS. 12A and 12B where FIG. 12A is a simplified bottom perspective view of a replaceable mesh assembly 1200 and FIG. 12B is a simplified perspective view of a portion of an earbud 1250 including an acoustic opening 1262.

Figure 12A:
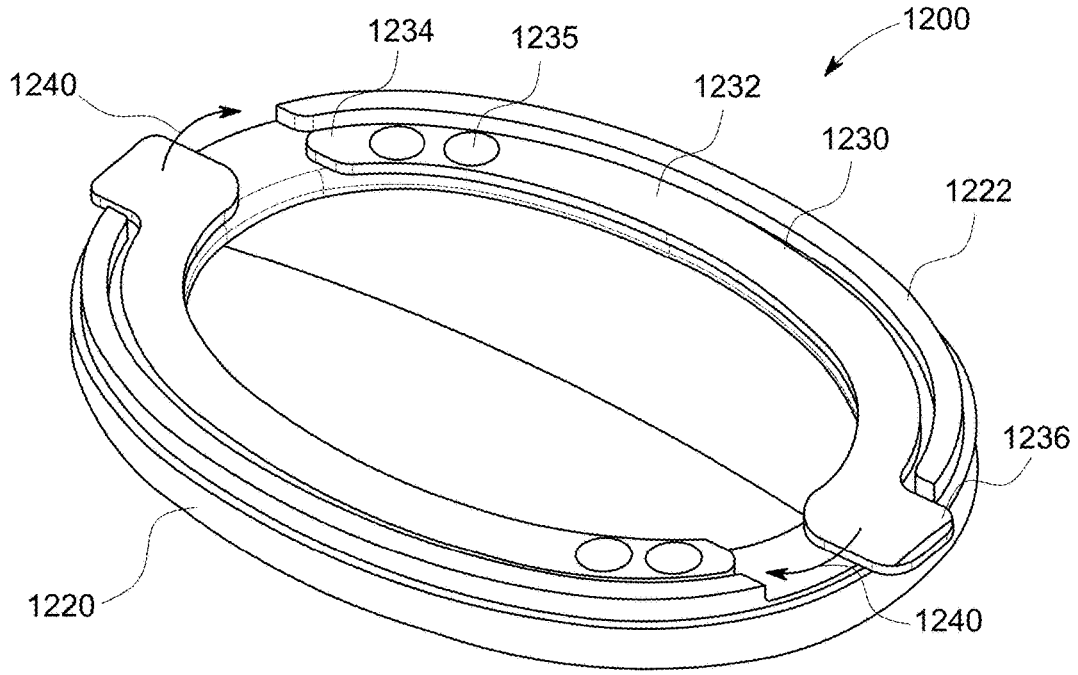
FIG. 12A is a simplified perspective view of a replaceable mesh according to some embodiments.

As shown in FIG. 12A, replaceable mesh assembly 1200 can include a snorkel mesh 1220 that can include a supporting frame similar to snorkel mesh 920 discussed above. First and second springs 1230 can be disposed in an opposing relationship and attached to snorkel mesh 1220. Each spring 1230 can have a curved body 1232 that extends along its length between opposing first and second ends 1234, 1236. Body 1232 can be laser welded (e.g., with welds 1235) to the supporting frame of mesh 1220 at its first end 1234. Spring 1230 is not bonded to snorkel mesh 1220 at its second end 1236 which allows the second end to be rotated under pressure (e.g., compressed) in the direction 1240 as shown in FIG. 12A. When compressed in this manner, a tab 1238 at the second end 1236 is moved from a position in which the tab extends out past an outer periphery of a wall 1222 of snorkel mesh 1220 to a position in which the tab 1238 is fully within an inner perimeter of wall 1222.

Figure 12B:
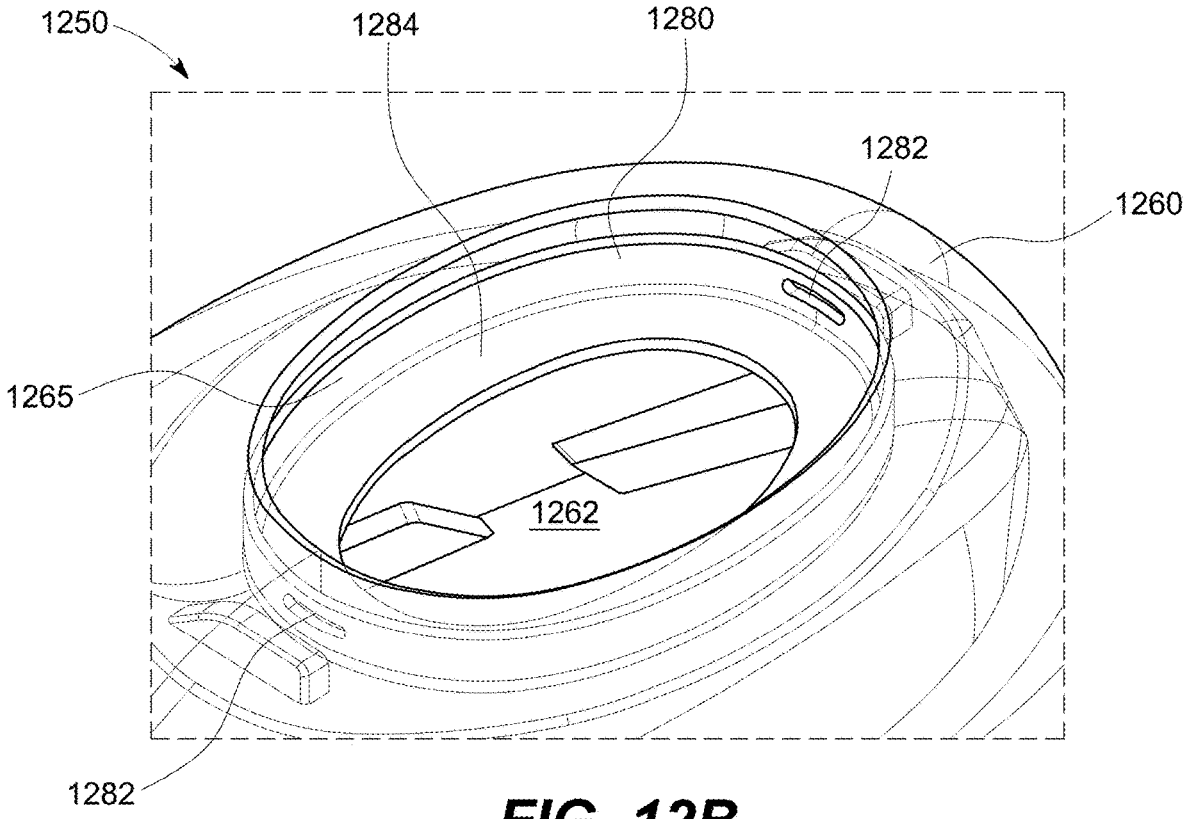
FIG. 12B is a simplified perspective view of a portion of an earbud including the replaceable mesh depicted in FIG. 12A.

Referring now to FIG. 12B, a permanent assembly 1250 can be affixed within an acoustic opening of an earbud and can include a snap frame 1280 bonded to an inner wall 1265 of the speaker housing 1260 that defines an acoustic opening 1262 of the earbud. Permanent assembly 1250 can include a snap frame 1280 that has first and second openings 1282 at opposing ends that align with tabs 1236 when replaceable mesh assembly 1200 is inserted into acoustic opening 1262 and pressed against a mounting face 1284 of snap frame 1280. Similar to the embodiment discussed with respect to FIGS. 11A-11C, a custom tool can be used to attach and deattach the replaceable mesh assembly 1200 from speaker housing 1260. For example, the tool can be inserted over the replaceable mesh assembly along an outer surface of wall 1222 and rotated or otherwise moved in direction 1240 to compress the tabs 1238. When tabs 1238 are so compressed, replaceable mesh assembly 1200 can be fully inserted into acoustic opening 1262. Then, when the tool is removed, springs 1230 bias tabs 1238 back to their initial position such that the tabs extend through the opposing openings 1282 locking the replaceable mesh assembly 1200 to speaker housing 1260. The custom tool can then later be used to remove the replaceable mesh assembly from the speaker housing in essentially the same manner.

In some embodiments springs 1230 can be made from sheet metal and the entire replaceable mesh assembly can be designed to minimize its height. When designed as such, when the assembly is snapped onto speaker housing 1260 within acoustic opening 1262, the outer surface of the mesh assembly can be recessed from the outer surface of speaker housing 1260 by a distance that helps minimize the accumulation of ear wax on the snorkel mesh in the first place.

Figure 13:
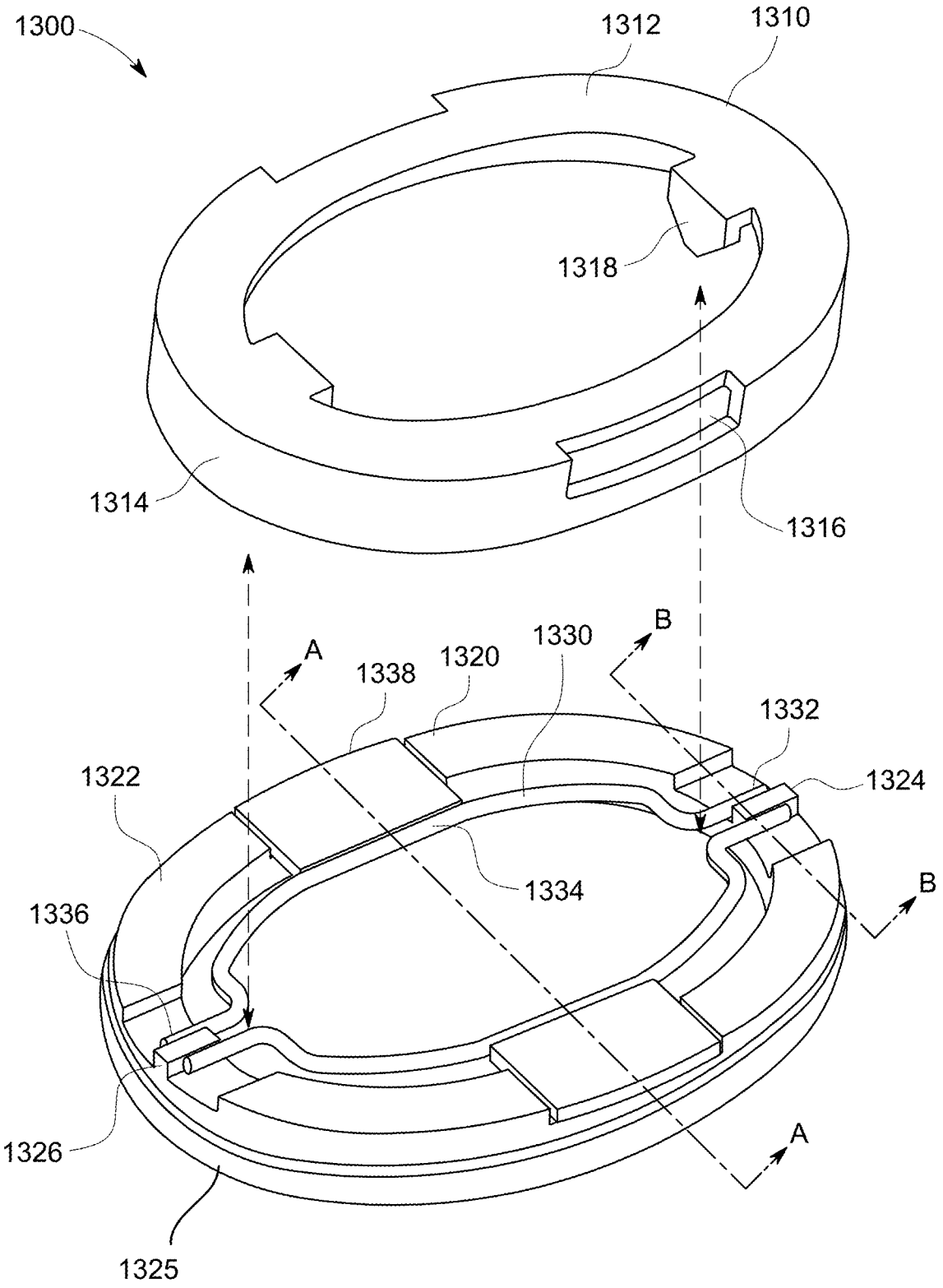
FIG. 13 is a simplified perspective view of a replaceable mesh according to some embodiments.

FIG. 13 is a simplified perspective view of an embodiment of a mesh assembly 1300. Mesh assembly 1300 includes a permanent assembly or frame 1310 and a replaceable mesh assembly 1320 that includes a snorkel mesh 1325 and a pair of wire form springs 1330. In some embodiments, frame 1310 can be bonded or otherwise attached to an earbud housing such that the frame 1310 sits within an acoustic opening, such as acoustic opening 914. Frame 1310 can be made out of a stiff material such as a hard plastic or a metal and can include a sidewall 1314 that extends away from a substantially planar surface 1312. Two openings 1316 are formed on opposite sides of the frame through sidewall 1314 and two spring activation wedges 1318 are formed on opposing sides of the frame between the two openings 1316.

Snorkel mesh 1325 can include a multilayer mesh similar to, for example, snorkel mesh 920 described above. Snorkel mesh 1325 can also include a stiffener 1322 at its bottom surface that has cutouts (not labeled) to hold various portions of the wire form springs 1330. First and second supports 1324, 1326 can be disposed at opposite ends of the stiffener with each of the supports centered within one of the cutouts, while two additional cutouts are disposed in an opposing relationship with each other and radially spaced away from the supports by 90 degrees.

Each wire form spring 1330 can include a u-shaped portion 1334 disposed between first and second opposing ends 1332, 1336 and a tab 1338 centered along and attached to the u-shaped portion 1334. As shown in FIG. 13, the ends 1332 in the pair of wire form springs 1330 include segments that are parallel to and spaced apart from each other on opposite sides of support 1324. Similarly, the ends 1336 include segments that are parallel to and spaced apart from each other on opposite sides of support 1326. Each tab 1338 of the wire form springs is sized to fit within one of the cutouts disposed between the two supports 1324, 1326 such that a bottom surface of the tabs is approximately planar with a bottom surface of stiffener 1322.

FIG. 13 depicts the springs 1330 in their natural, preloaded state. Replaceable mesh assembly 1320 can be removably attached to an earbud by aligning the replaceable mesh with frame 1310 and pressing the mesh assembly into the frame. When properly positioned the two tabs 1338 of the replaceable mesh assembly 1320 align with the two openings 1316 of the frame and each of the pair of ends 1332 and 1334 aligns with one of the spring activation wedges 1318.

Figure 14A:
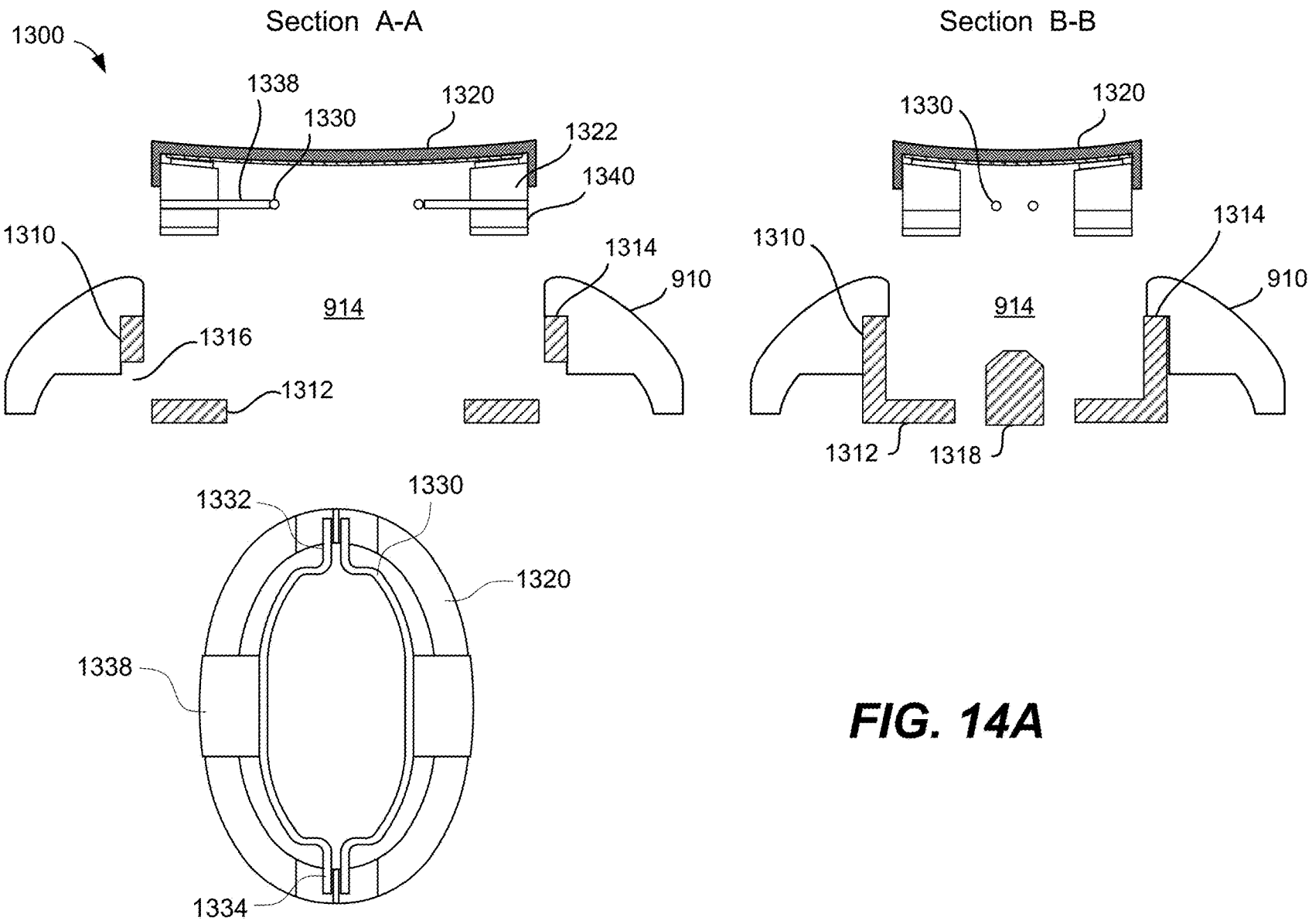
FIGS. 14A-14D are simplified cross-sectional views of the replaceable mesh assembly 1320 shown in FIG. 13 along different planes along with a simplified plan views of the wire form springs in the mesh assembly as the springs are loaded by the spring activation wedges during the mesh insertion process.

Reference is now made to FIGS. 14A-14D, which depict a sequence of events that occurs when the replaceable mesh assembly 1320 is properly aligned with and pressed into frame 1310. Each of FIGS. 14A through 14D depicts a simplified cross-sectional view of the mesh assembly 1300 along both of planes A-A and B-B depicted in FIG. 13 along with a simplified plan view of the replaceable mesh assembly 1320 including wire form springs 1330 as the springs are loaded by the spring activation wedges 1318. Referring first to FIG. 14A, replaceable assembly 1320 is shown directly above an acoustic opening 914 formed through speaker housing 910. Additionally, frame 1310 is attached to speaker housing 910 within the acoustic opening providing a receptacle for the replaceable mesh assembly 1320 as described below and a retaining ring 1340 is shown coupled to the stiffener 1322 to retain springs 1330 to the replaceable mesh. In some embodiments retaining ring 1340 can be made from a stamped sheet of metal or a similarly rigid material.

As the wire form springs 1330, in FIG. 14A, are not yet in contact with wedges 1318, the springs 1330 are in the same pre-loaded state as shown in FIG. 13. Additionally, the ends 1332 of the springs 1330 are pressed against support 1324, the two ends 1336 are pressed against support 1326 and each tab 1338 extends into its respective cutout in stiffener 1322 without protruding past the outer edge of the stiffener.

Figure 14B:
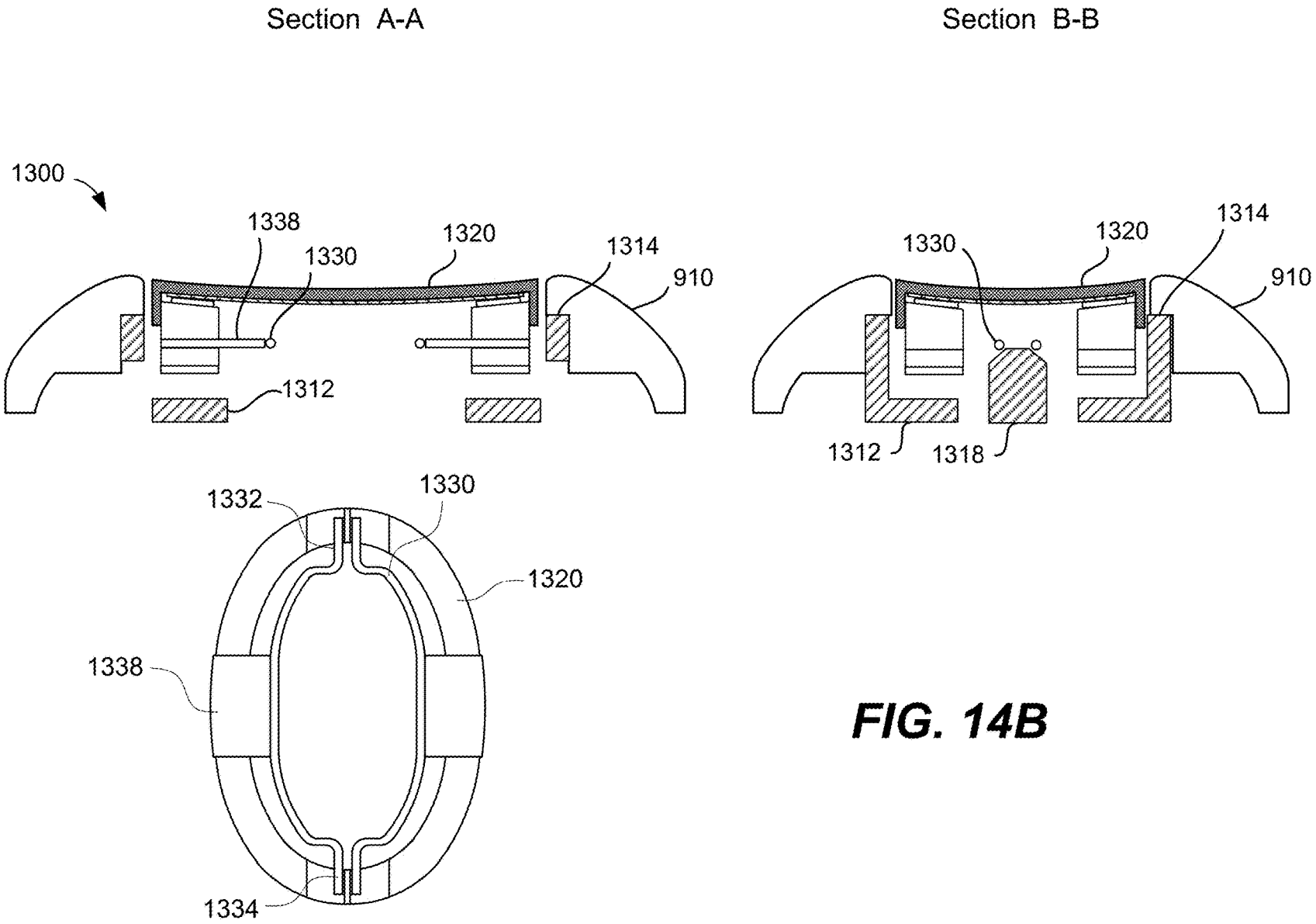
Figure 14C:
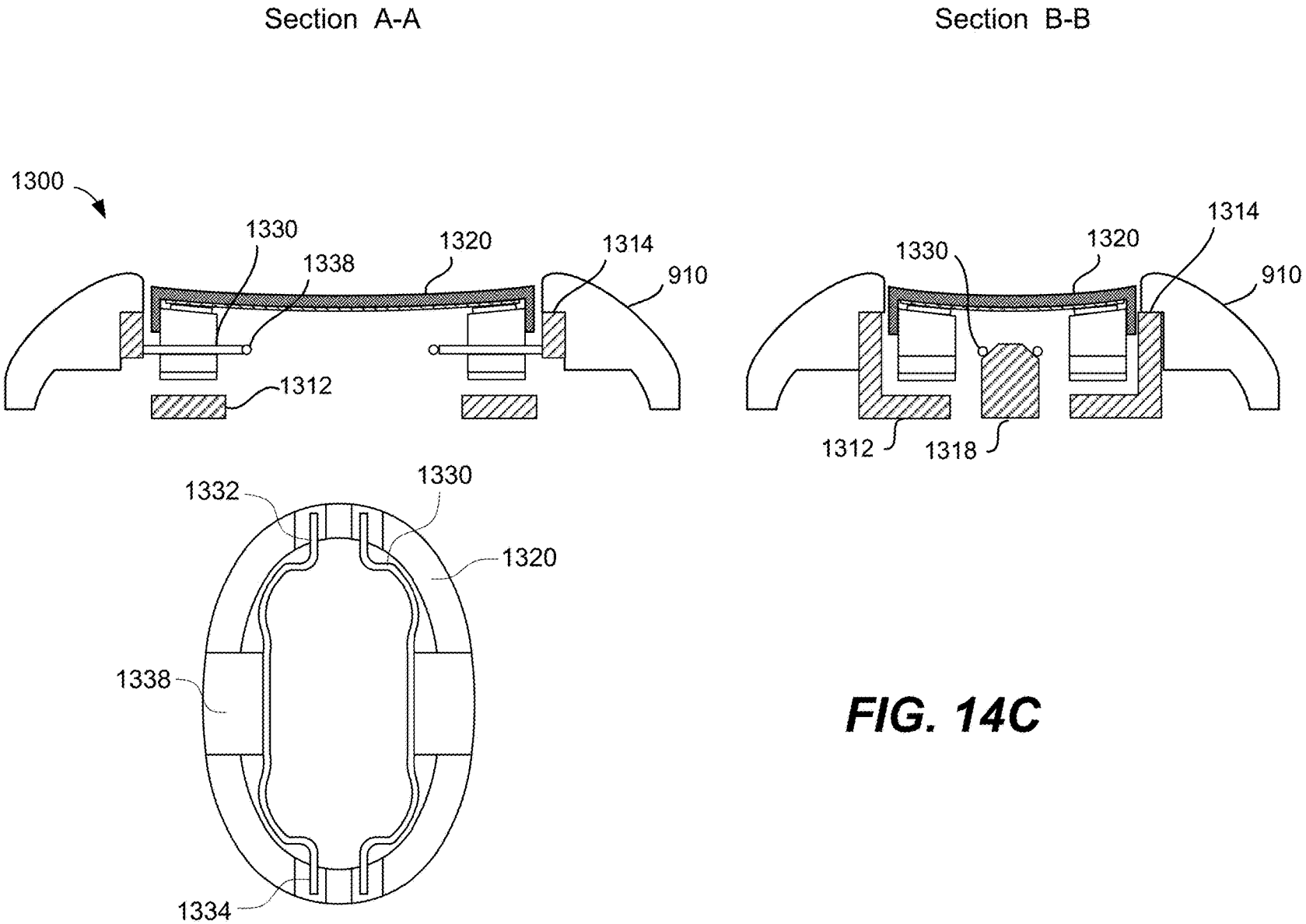
Figure 14D:
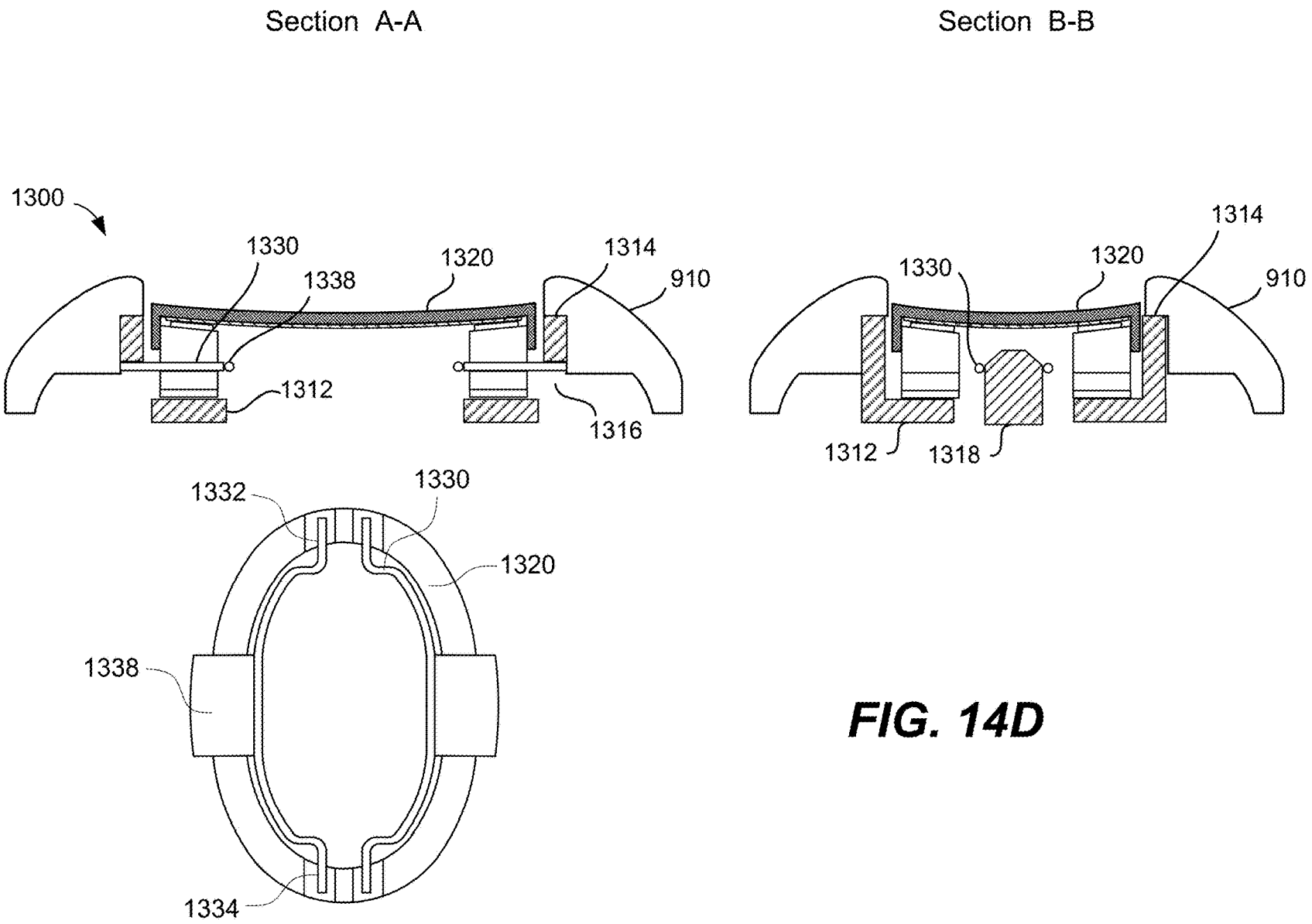

In FIG. 14B, replaceable mesh assembly 1320 is moved into acoustic opening 914 but the springs 1330 are not yet in contact with wedges 13198 and are thus still in the pre-loaded condition and the ends 1332, 1336 and tabs 1338 are all positioned as discussed above with respect to FIG. 14A. As the replaceable mesh assembly 1320 is pressed further into the acoustic opening, however, the ends of the springs 1330 come into contact with the angled surface of the wedges 1318 driving the two ends 1332 away from each other and driving the two ends 1336 away from each other as shown in FIG. 14C. As the pairs of ends 1332 and 1334 are split apart, tabs 1338 are pushed out of their respective channels with the ends of each tab 1338 contacting the sidewall 1314 of frame 1310. Then, as the replaceable mesh assembly 1320 is pressed still further into the acoustic opening, the ends of the springs 1330 move past the angled portion of wedges 1318 and the ends of tabs 1338 are snapped into the two opposing holes 1316 locking the replaceable mesh assembly to frame 1310.

The foregoing description, for purposes of explanation, used specific nomenclature to provide a thorough understanding of the described embodiments. However, it will be apparent to one skilled in the art that the specific details are not required in order to practice the described embodiments. For example, while earphones 100 were described as in-ear headphones having a compressible ear tip that can be inserted into a user's ear canal providing an acoustic seal within the ear canal, in other embodiments earphones 100 can have a hard plastic or similar housing structure that is not compressible and that sits within a user's ear adjacent to his or her ear canal. Also, while earphones 100 were described as having electrical contacts to enable a charging case to recharge the battery within the earphones, in other embodiments the earphones can be recharged wirelessly through a wireless power receiving coil or similar element.

As another example, while several embodiments described above a mechanical attachment mechanism in which a wire form spring is attached to the permanent assembly by an attachment element or by hooks or other attachment features of components within the permanent assembly, in some embodiments portions of the wire form assembly can be insert molded within the earphone housing, within the acoustic frame or within another component that is part of the permanent assembly. The insert molded portions can anchor the wire form to the permanent assembly while portions of the wire form that the replaceable assembly can latch onto are not insert molded over. As still another example, in some embodiments the mechanical attachment mechanism can have a release mechanism that can be activated at the push of a button, electronically or by any other appropriate means. Thus, the foregoing descriptions of the specific embodiments described herein are presented for purposes of illustration and description. They are not target to be exhaustive or to limit the embodiments to the precise forms disclosed. Also, while different embodiments of the invention were disclosed above, the specific details of particular embodiments may be combined in any suitable manner without departing from the spirit and scope of embodiments of the invention. Further, it will be apparent to one of ordinary skill in the art that many modifications and variations are possible in view of the above teachings.

Finally, it is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

What is claimed is:

1. A wireless earphone comprising:

a housing that defines an interior cavity having an inner surface and an outer surface;

an opening extending through the housing from the inner surface to the outer surface; and a mesh assembly disposed over the opening and comprising a permanent assembly coupled to the housing and a replaceable assembly removably coupled to the permanent assembly and comprising a mesh;

wherein the replaceable assembly is removably coupled to the permanent assembly by a wire form attachment.

2. The wireless earphone set forth in claim 1 wherein the mesh comprises an acoustic mesh and an outer cosmetic mesh.

3. A wireless earbud comprising:

a housing that defines an interior cavity having an inner surface and an outer surface;

an acoustic opening extending through the housing from the inner surface to the outer surface;

an audio driver disposed within the interior cavity and aligned to emit sound through the acoustic opening; and a mesh assembly disposed over the acoustic opening, the mesh assembly comprising a permanent assembly affixed to the housing and a replaceable assembly removably coupled to the permanent assembly, the replaceable assembly comprising a mesh that includes an acoustic mesh and an outer cosmetic mesh;

wherein the mesh further comprises an annular frame having a central opening aligned with the acoustic opening and wherein the acoustic mesh is disposed between the annular frame and the cosmetic mesh.

4. The wireless earbud set forth in claim 3 wherein the permanent assembly comprises first and second springs, each spring including a finger at its distal end and wherein the replaceable assembly includes first and second opening formed through a sidewall of the annular frame where a finger of each spring is aligned with and protrudes through a respective one of the first or second openings when the replaceable assembly is coupled to the permanent assembly.

5. The wireless earbud set forth in claim 3 wherein the replaceable assembly comprises first and second springs, each spring including a tab at its distal end and wherein the permanent assembly includes first and second openings formed through the annular frame where a tab of each spring is aligned with and protrudes through a respective one of the first or second openings when the replaceable assembly is coupled to the permanent assembly.

6. The wireless earbud set forth in claim 5 wherein the first and second springs are wire form springs positioned in a mirrored relationship with each other.

7. The wireless earbud set forth in claim 6 wherein each wire form spring comprises first and second end segments at opposing ends of the spring and a central u-shaped section between the first and second end segments.

8. The wireless earbud set forth in claim 7 wherein the tab portion of each wire form spring is coupled to the central u-shaped section and extends into a cutout region of the annular frame.

* * * * *